US011133595B2

(12) United States Patent
Park et al.

(10) Patent No.: US 11,133,595 B2
(45) Date of Patent: Sep. 28, 2021

(54) ANTENNA MODULE USING METAL BEZEL AND ELECTRONIC DEVICE INCLUDING THEREOF

(71) Applicant: Samsung Electronics Co., Ltd., Gyeonggi-do (KR)

(72) Inventors: Sungchul Park, Gyeonggi-do (KR); Wonjoon Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/724,920

(22) Filed: Dec. 23, 2019

(65) Prior Publication Data

US 2020/0212584 A1 Jul. 2, 2020

(30) Foreign Application Priority Data

Dec. 28, 2018 (KR) ..... 10-2018-0171607

(51) Int. Cl.

| | |
|---|---|
| ***H01Q 13/18*** | (2006.01) |
| ***H01Q 1/24*** | (2006.01) |
| ***H01Q 21/06*** | (2006.01) |
| ***H01Q 5/35*** | (2015.01) |

(52) U.S. Cl.

CPC ..... *H01Q 13/18* (2013.01); *H01Q 1/243* (2013.01); *H01Q 5/35* (2015.01); *H01Q 21/064* (2013.01)

(58) Field of Classification Search

CPC ..... H01Q 21/064; H01Q 1/243; H01Q 13/18; H01Q 13/16; H01Q 1/38; H01Q 21/08; H01Q 5/35; H01Q 3/28; H01Q 3/36

See application file for complete search history.

(56) References Cited

U.S. PATENT DOCUMENTS

| | | | | |
|---|---|---|---|---|
| 7,071,883 | B2 * | 7/2006 | Cubley | H01Q 1/2266 343/702 |
| 7,417,596 | B2 * | 8/2008 | Zellweger | H01Q 1/273 343/702 |
| 7,466,269 | B2 | 12/2008 | Haziza | |
| 7,466,281 | B2 | 12/2008 | Haziza | |
| 7,554,505 | B2 | 6/2009 | Haziza | |

(Continued)

FOREIGN PATENT DOCUMENTS

| | | | |
|---|---|---|---|
| CN | 106058436 | A | 10/2016 |
| KR | 10-2017-0084632 | A | 7/2017 |
| KR | 10-2018-0060299 | A | 6/2018 |

OTHER PUBLICATIONS

International Search Report dated Apr. 28, 2020.

*Primary Examiner* — Graham P Smith
*Assistant Examiner* — Jae K Kim
(74) *Attorney, Agent, or Firm* — Cha & Reiter, LLC

(57) ABSTRACT

Disclosed is an electronic device including a metal bezel including a bezel patch separated through a bezel slit, a printed circuit board including a first conductive pattern and a second conductive pattern, which are separated through a substrate slit and a communication module transmitting or receiving an antenna signal, using an antenna element including the bezel patch, the first conductive pattern, and the second conductive pattern. The first conductive pattern is connected to a part of the metal bezel. The bezel patch and the second conductive pattern is arranged to be aligned vertically. A bezel cavity is formed between the bezel patch and the second conductive pattern.

20 Claims, 30 Drawing Sheets

(56) References Cited

U.S. PATENT DOCUMENTS

| | | | | |
|---|---|---|---|---|
| 7,656,358 | B2 * | 2/2010 | Haziza | H01Q 13/00 343/772 |
| 7,656,359 | B2 | 2/2010 | Haziza | |
| 7,876,274 | B2 * | 1/2011 | Hobson | H01Q 1/243 343/702 |
| 7,884,766 | B2 | 2/2011 | Haziza | |
| 7,884,779 | B2 | 2/2011 | Haziza | |
| 7,961,153 | B2 | 6/2011 | Haziza | |
| 8,467,272 | B2 * | 6/2013 | Fujisawa | G04C 10/02 368/47 |
| 8,570,223 | B2 | 10/2013 | Arslan et al. | |
| 9,035,840 | B1 * | 5/2015 | Lee | H01Q 9/0471 343/770 |
| 9,099,790 | B2 * | 8/2015 | Chen | H01Q 21/00 |
| 9,105,966 | B1 * | 8/2015 | Dou | H01Q 1/243 |
| 9,196,952 | B2 * | 11/2015 | Tran | H01Q 13/10 |
| 9,767,422 | B2 * | 9/2017 | Ray | G07F 19/2055 |
| 10,069,204 | B2 * | 9/2018 | Kim | H01Q 9/0421 |
| 10,116,039 | B2 * | 10/2018 | Lee | H01Q 1/243 |
| 10,276,594 | B2 * | 4/2019 | Yamazaki | H01L 27/124 |
| 10,286,176 | B2 * | 5/2019 | Zapol | C01B 21/32 |
| 10,629,982 | B2 * | 4/2020 | Kim | H04B 1/3888 |
| 10,732,578 | B2 * | 8/2020 | Fujisawa | G04R 60/12 |
| 10,879,606 | B2 * | 12/2020 | Ruaro | H01Q 1/52 |
| 10,924,148 | B2 * | 2/2021 | Holtz | A45C 11/00 |
| 10,944,158 | B2 * | 3/2021 | Sayem | H01Q 5/50 |
| 2008/0117113 | A1 | 5/2008 | Haziza | |
| 2018/0358686 | A1 * | 12/2018 | Park | H01Q 9/42 |
| 2019/0229401 | A1 * | 7/2019 | Yong | H01Q 21/064 |

* cited by examiner

ANTENNA MODULE USING METAL BEZEL AND ELECTRONIC DEVICE INCLUDING THEREOF

CROSS-REFERENCE TO RELATED APPLICATION(S)

This application is based on and claims priority under 35 U.S.C. § 119 to Korean Patent Application No. 10-2018-0171607, filed on Dec. 28, 2018, in the Korean Intellectual Property Office, the disclosure of which is incorporated by reference herein its entirety.

BACKGROUND

1. Field

The disclosure relates to the antenna technology using the metal bezel of an electronic device.

2. Description of Related Art

As mobile communication technologies develop, an electronic device, which is equipped with an antenna, such as a smartphone, a wearable device, or the like is widely supplied. The electronic device may receive or transmit a signal including data (e.g., a message, a photo, a video, a music file, a game, and the like) through the antenna. In the electronic device, a signal that is received by using the antenna is provided to a radio frequency integrated circuit (RFIC).

The above information is presented as background information only to assist with an understanding of the disclosure. No determination has been made, and no assertion is made, as to whether any of the above might be applicable as prior art with regard to the disclosure.

SUMMARY

In accordance with an aspect of the disclosure, an electronic device comprises a metal bezel including a bezel patch separated through a bezel slit; a printed circuit board including a first conductive pattern and a second conductive pattern separated by a substrate slit; and a communication module configured to transmit or receive radio frequency signals using the separation bezel part, the first conductive pattern, and the second conductive pattern, wherein the first conductive pattern is connected to a part of the metal bezel; wherein the second conductive pattern is disposed directly under the bezel patch, and wherein a bezel cavity is formed between the separation bezel part and the second conductive pattern.

In accordance with another aspect of the disclosure an electronic device comprises a metal bezel; an antenna array formed in a part of the metal bezel; and a communication module configured to transmit or receive an antenna signal, using the antenna array, wherein the antenna array includes: a plurality of bezel patches separated from the metal bezel through a plurality of bezel slits; and a printed circuit board including a plurality of first conductive patterns and a plurality of second conductive patterns, wherein one of the first conductive patterns is separated from one of the second conductive patterns through a substrate slit, wherein the first conductive patterns is connected to the part of the metal bezel, wherein one of the plurality of bezel patches is disposed directly above one of the second conductive patterns, and wherein a bezel cavity is formed between the one of the plurality of bezel patches and the one of the second conductive patterns.

In accordance with another aspect of this disclosure, an antenna module formed in a part of a metal bezel of an electronic device, comprises: a bezel patch separated from the metal bezel through a bezel slit; and a printed circuit board including a first conductive pattern and a second conductive pattern, which are separated through a substrate slit, wherein the first conductive pattern is connected to a part of the metal bezel, wherein the second conductive pattern is disposed directly below the bezel patch, and wherein a bezel cavity is formed between the bezel patch and the second conductive pattern.

Other aspects, advantages, and salient features of the disclosure will become apparent to those skilled in the art from the following detailed description, which, taken in conjunction with the annexed drawings, discloses certain embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

An antenna of an electronic device can be implemented by using a plurality of antenna elements for the purpose of receiving or transmitting a signal more efficiently. For example, the electronic device may include one or more antenna arrays in each of which a plurality of antenna elements are arranged in a regular shape. The antenna array has an effective isotropically radiated power (EIRP) greater than one antenna element. As such, the electronic device that includes an antenna array may receive or transmit a signal efficiently.

Metal bezels are increasingly used in electronic devices using antennas. The metal bezel is used to block or reflect the radiation path of the antenna. When the metal bezel is used in the electronic device, it may be difficult to secure beam coverage on the side surface (e.g., the direction of the metal bezel) of the electronic device. The metal bezel divided into several portions in the electronic device is used to secure the beam coverage. However, when the metal bezel is divided into several portions, the metal bezel may significantly affect the appearance of the electronic device.

Aspects of the disclosure are to address at least the above-mentioned problems and/or disadvantages and to provide at least the advantages described below. Accordingly, an aspect of the disclosure is to provide an antenna module which does not affect the appearance of an electronic device by forming a very thin slit on a metal bezel and by forming an antenna module on the metal bezel itself.

Furthermore, another aspect of the disclosure is to provide an antenna module having a plurality of frequency bands by forming a plurality of slits of different sizes on a metal bezel.

Moreover, another aspect of the disclosure is to form an antenna module that is formed on a metal bezel itself and is used as a key input device.

Hereinafter, certain embodiments of the disclosure may be described with reference to accompanying drawings. Accordingly, those of ordinary skill in the art will recognize that modification, equivalent, and/or alternative on the certain embodiments described herein can be variously made without departing from the scope and spirit of the disclosure.

Figure 1:
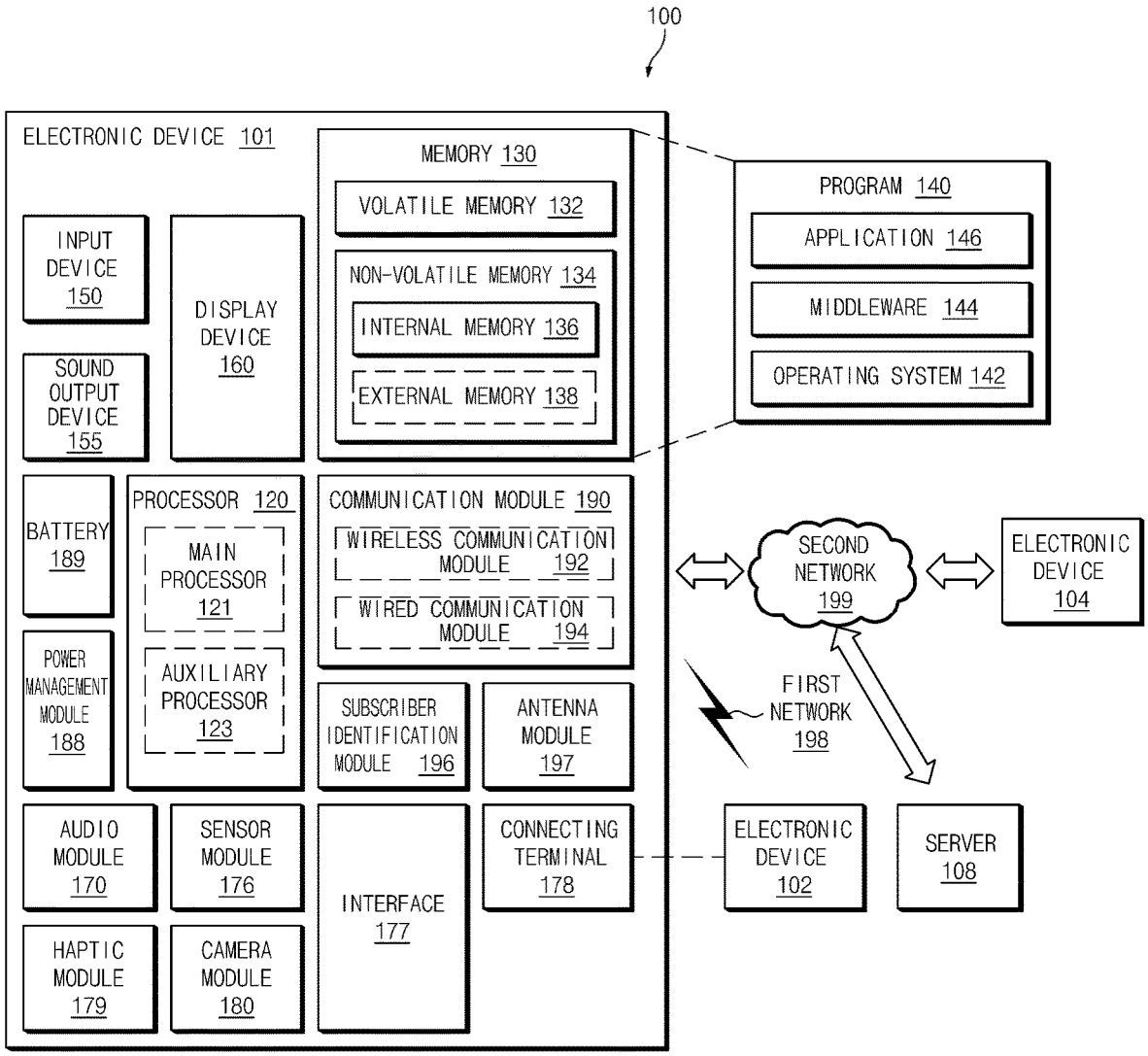
FIG. 1 is a block diagram illustrating an electronic device in a network environment according to certain embodiments.

FIG. 1 is a block diagram illustrating an electronic device 101 in a network environment 100 according to certain embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thererto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

Figure 2A:
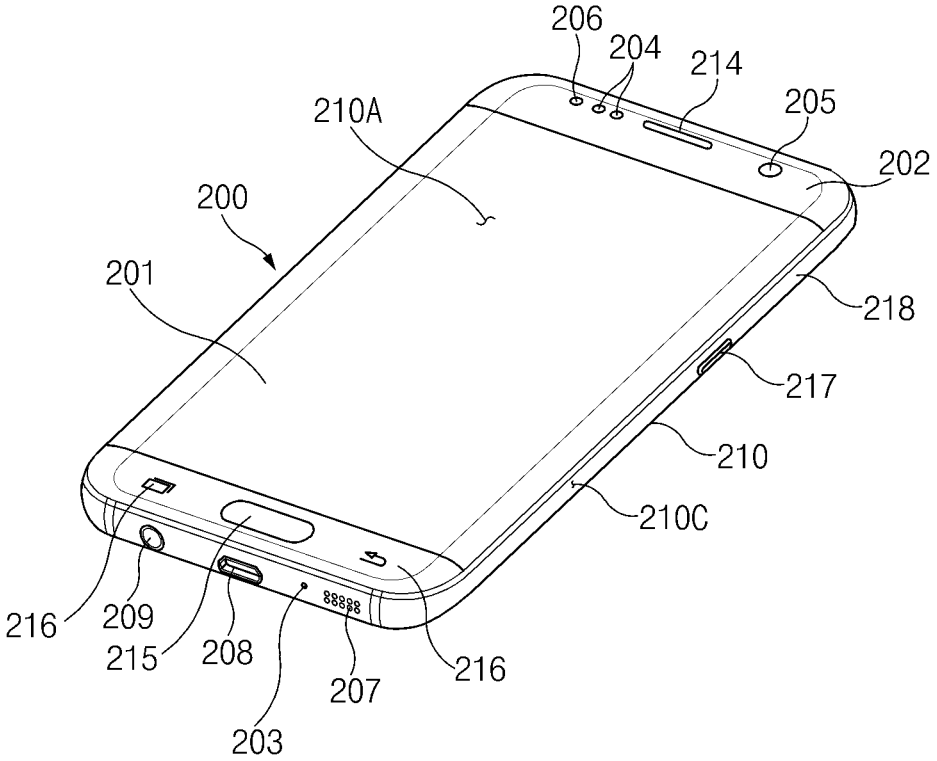
FIG. 2A is a front perspective view of a mobile electronic device according to an embodiment.
Figure 2B:
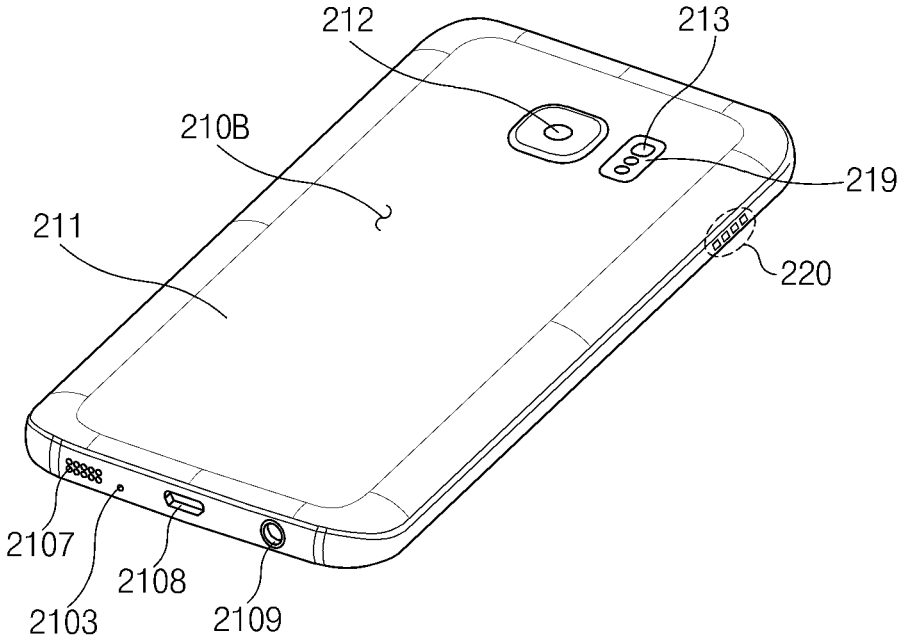
FIG. 2B is a back perspective view of an electronic device of FIG. 2A.

FIG. 2A is a front perspective view of a mobile electronic device according to an embodiment. FIG. 2B is a back perspective view of an electronic device of FIG. 2A.

Referring to FIGS. 2A and 2B, an electronic device 200 (e.g., the electronic device 100) according to an embodiment may include a housing 210 including a first surface (or a front surface) 210A, a second surface (or a back surface) 210B, and a side surface 210C surrounding a space between the first surface 210A and the second surface 210B. In another embodiment (not illustrated), a housing may refer to a structure which forms a part of the first surface 210A, the second surface 210B, and side surfaces 210C of FIGS. 2A and 2B. According to an embodiment, the first surface 210A may be implemented with a front plate 202 (e.g., a glass plate including various coating layers, or a polymer plate), at least a portion of which is substantially transparent. The second surface 210B may be implemented with a back plate 211 that is substantially opaque. For example, the back plate 211 may be implemented with a coated or colored glass, a ceramic, a polymer, a metal (e.g., aluminum, stainless steel (STS), or magnesium), or a combination of at least two of the materials. The side surface 210C may be coupled with the front plate 202 or the back plate 211 and may be implemented with a side bezel structure (or a "side member") 218 including a metal and/or a polymer. In an embodiment, the back plate 211 and the side bezel structure 218 may be integrally formed and may include the same material (e.g., a metal material such as aluminum).

According to an embodiment, the electronic device 200 may include at least one or more of a display 201 (e.g., the display device 160), an audio module (203, 207, 214) (e.g., the audio module 170), a sensor module (204, 219) (e.g., the sensor module 176), a camera module (205, 212, 213) (e.g., the camera module 180), an antenna module 220 (e.g., an antenna module 197), a key input device (215, 216, 217) (e.g., an input device 150), an indicator 206, and a connector hole (208, 209). In any embodiment, the electronic device 200 may not include at least one (e.g., the key input device (215, 216, 217) or the indicator 206) of the components or may further include any other component (e.g., a pen input device).

The display 201 may be exposed through a considerable portion of the front plate 202, for example. In an embodiment, at least part of the display 201 may be exposed through the front plate 202 forming the first surface 210A. In an embodiment, a corner of the display 201 may be formed to be mostly identical to a shape of an outer portion of the front plate 202 adjacent thereto. In another embodiment (not illustrated), to increase the area where the display 201 is exposed, a difference between an outer portion of the display 201 and an outer portion of the front plate 202 may be formed mostly identically.

In another embodiment (not illustrated), a recess or an opening may be defined in a portion of a screen display region of the display 201, and at least one or more of the audio module 214, the sensor module 204, the camera module 205, and the indicator 206 may be provided to be aligned with the recess or the opening. In another embodiment (not illustrated), at least one or more of the audio module 214, the sensor module 204, the camera module 205, and the indicator 206 may be provided on a back surface of the display 201, which corresponds to the screen display region. In another embodiment (not illustrated), the display 201 may be combined with a touch sensing circuit, a pressure sensor capable of measuring the intensity (or pressure) of a touch, and/or a digitizer capable of detecting a magnetic stylus pen or may be disposed adjacent thereto.

The audio module (203, 207, 214) may include the microphone hole 203 and the speaker hole (207, 214). A microphone for obtaining external sound may be disposed within the microphone hole 203; in an embodiment, a plurality of microphones may be disposed to make it possible to detect a direction of sound. The speaker hole (207, 214) may include the external speaker hole 207 and the receiver hole 214 for call. In an embodiment, the speaker hole (207, 214) and the microphone hole 203 may be implemented with one hole, or a speaker (e.g., a piezoelectric speaker) may be included without the speaker hole (207, 214).

The sensor module (204, 219) may generate an electrical signal or a data value corresponding to an internal operation state of the electronic device 200 or corresponding to an external environment state. The sensor module (204, 219) may include, for example, the first sensor module 204 (e.g., a proximity sensor) and/or a second sensor module (not illustrated) (e.g., a fingerprint sensor) positioned on the first surface 210A of the housing 210, and/or the third sensor module 219 (e.g., a heart rate monitor (HRM) sensor) positioned on the second surface 210B of the housing 210. The fingerprint sensor may be positioned on the second surface 210B as well as the first surface 210A (e.g., the display 201) of the housing 210. The electronic device 200 may further include a sensor module not illustrated, for example, at least one of a gesture sensor, a gyro sensor, a barometric pressure sensor, a magnetic sensor, an acceleration sensor, a grip sensor, a color sensor, an infrared (IR) sensor, a biometric sensor, a temperature sensor, a humidity sensor, or the illumination sensor 204.

The camera module (205, 212, 213) may include the first camera device 205 positioned on the first surface 210A of the electronic device 200, and the second camera module 212 and/or the flash 213 positioned on the second surface 210B. The camera devices 205 and 212 may include one or more lenses, an image sensor, and/or an image signal processor. The flash 213 may include, for example, a light emitting diode or a xenon lamp. In an embodiment, two or more lenses (e.g., an infrared camera and wide-angle and telephoto lenses) and image sensors may be disposed on one surface of the electronic device 200.

The key input device (215, 216, 217) may include the home key button 215 positioned on the first surface 210A of the housing 210, the touch pad 216 positioned in the vicinity of the home key button 215, and/or the side key button 217 positioned on the side surface 210C of the housing 210. In another embodiment, the electronic device 100 may not include all or a part of the aforementioned key input devices 215, 216, and 217, and the key input device 215, 216, and 217 not included may be implemented in the form of a soft key on the display 201.

The indicator 206 may be positioned, for example, on the first surface 210A of the housing 210. The indicator 206 may provide state information of the electronic device 200, for example, in the form of light, and may include an LED.

The connector hole (208, 209) may include the first connector hole 208 that is able to accommodate a connector (e.g., a USB connector) for transmitting/receiving a power and/or data to/from an external electronic device, and/or the second connector hole 209 that is able to accommodate a connector (e.g., an earphone jack) for transmitting/receiving an audio signal to/from the external electronic device.

Figure 3:
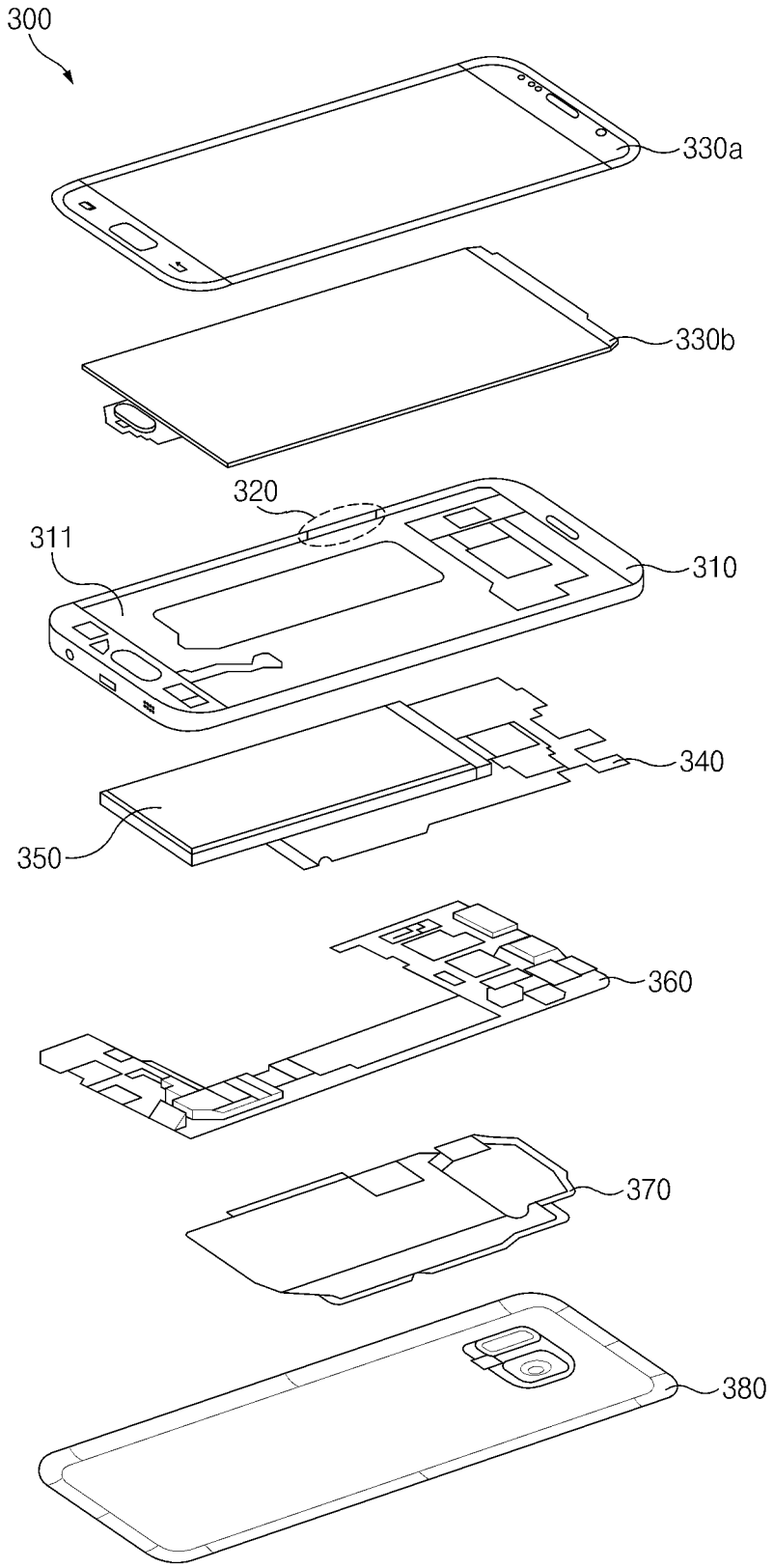
FIG. 3 is an exploded perspective view of an electronic device of FIGS. 2A and 2B.

FIG. 3 is an exploded perspective view of an electronic device of FIGS. 2A and 2B.

Referring to FIG. 3, an electronic device 300 (e.g., the electronic device 101) may include a side bezel structure 310, a first support member 311 (e.g., a bracket), a first antenna 320 (e.g., the antenna module 197), a front plate 330*a*, a display 330*b* (e.g., the display device 160), a printed circuit board 340, a battery 350 (e.g., the battery 189), a second support member 360 (e.g., a rear case), a second antenna 370 (e.g., the antenna module 197), and a rear plate 380. In any embodiment, the electronic device 300 may not include at least one (e.g., the first support member 311 or the second support member 360) of the components or may further include any other component. At least one of the components of the electronic device 300 may be similar to or the same as at least one of the components of the electronic device 200 of FIG. 2A or 2B. Thus, additional description will be omitted to avoid redundancy.

The first support member 311 may be disposed in the electronic device 300 so as to be connected with the side bezel structure 310, or may be integrally formed with the side bezel structure 310. The first support member 311 may be formed of, for example, a metal material and/or a nonmetal material (e.g., polymer). The display 330*b* may be coupled with one surface of the first support member 311, and the printed circuit board 340 may be coupled with an opposite surface of the first support member 311. A processor (e.g., the processor 120), a memory (e.g., the memory 130), and/or an interface (e.g., the interface 177) may be mounted on the printed circuit board 340. For example, the processor may include one or more of a central processing unit, an application processor, a graphic processing device, an image signal processor, a sensor hub processor, or a communication processor.

The memory may include, for example, a volatile memory or a nonvolatile memory.

The interface may include, for example, a high definition multimedia interface (HDMI), a universal serial bus (USB) interface, a secure digital (SD) card interface, and/or an audio interface. The interface may electrically or physically connect, for example, the electronic device 300 with an external electronic device and may include a USB connector, an SD card/MMC connector, or an audio connector.

The battery 350 that is a device for supplying a power to at least one component of the electronic device 300 may include, for example, a primary cell incapable of being recharged, a secondary cell rechargeable, or a fuel cell. At least a portion of the battery 350 may be disposed on substantially the same plane as the printed circuit board (PCB) 340, for example. The battery 350 may be integrally disposed within the electronic device 300, or may be disposed to be removable from the electronic device 300.

The first antenna 320 may be disposed in a part of the side bezel structure 310. For example, the first antenna 320 may include at least one antenna array. The antenna array may include a plurality of antenna elements. According to an embodiment, the plurality of antenna elements may be arranged in a specified layout. For example, the antenna array may include 4 antenna elements; and the antenna elements may be arranged in '1×4'. The electronic device 300 may transmit or receive data by transmitting or receiving an RF signal through the first antenna 320. The first antenna 320 may operate as a key input device (e.g., the side key button 217).

The second antenna 370 may be interposed between the rear plate 380 and the battery 350. The second antenna 370 may include, for example, a near field communication (NFC) antenna, an antenna for wireless charging, and/or a magnetic secure transmission (MST) antenna. For example, the second antenna 370 may perform short range communication with an external device or may wirelessly transmit/receive a power necessary to charge. In another embodiment, an antenna structure may be formed by a part of the side bezel structure 310 and/or the first support member 311, or by a combination thereof.

Figure 4A:
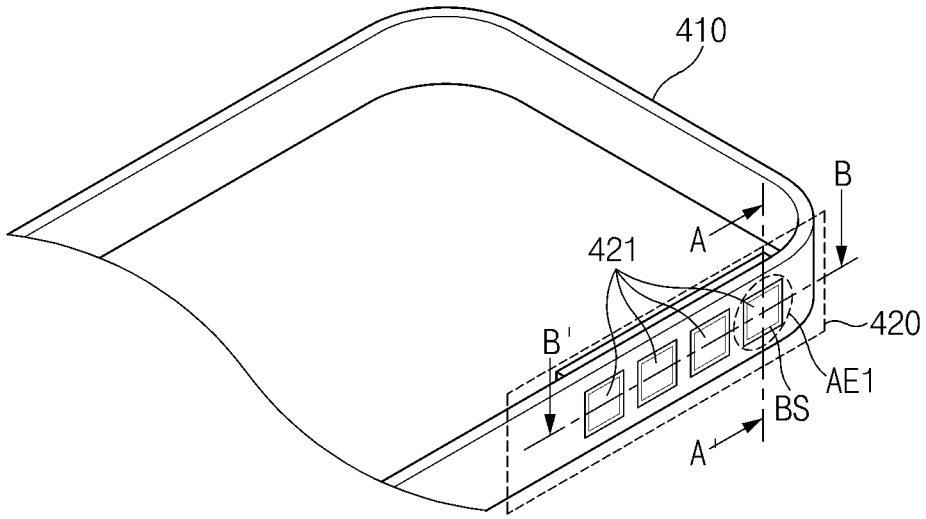
FIG. 4A is a view illustrating a structure of an antenna module, according to an embodiment of the disclosure.
Figure 4B:
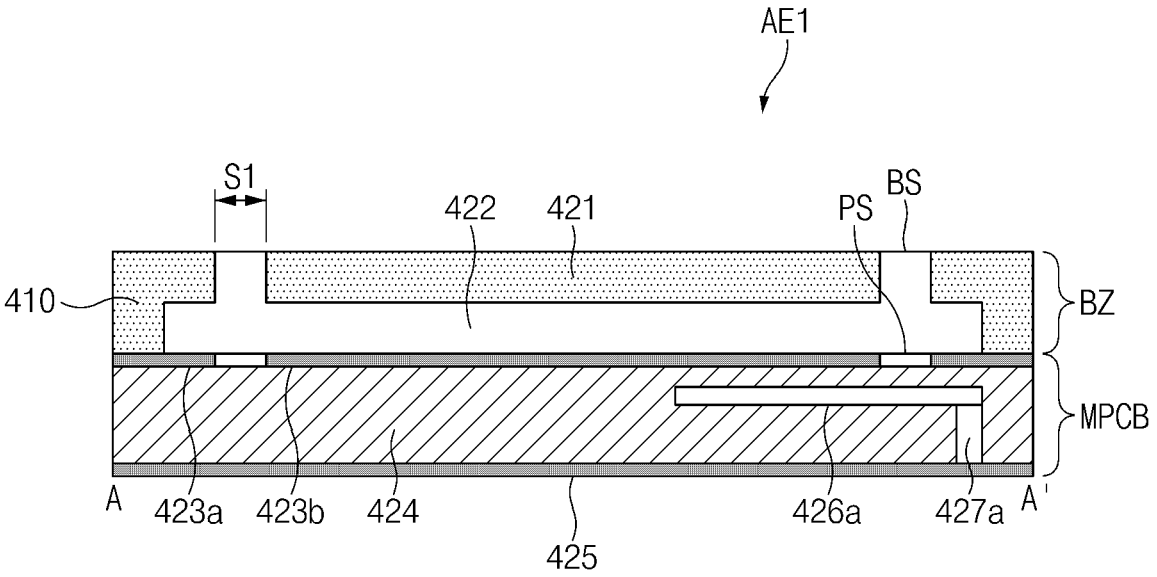
FIG. 4B is a cross-sectional view taken along a line A-A' of FIG. 4A.
Figure 4C:
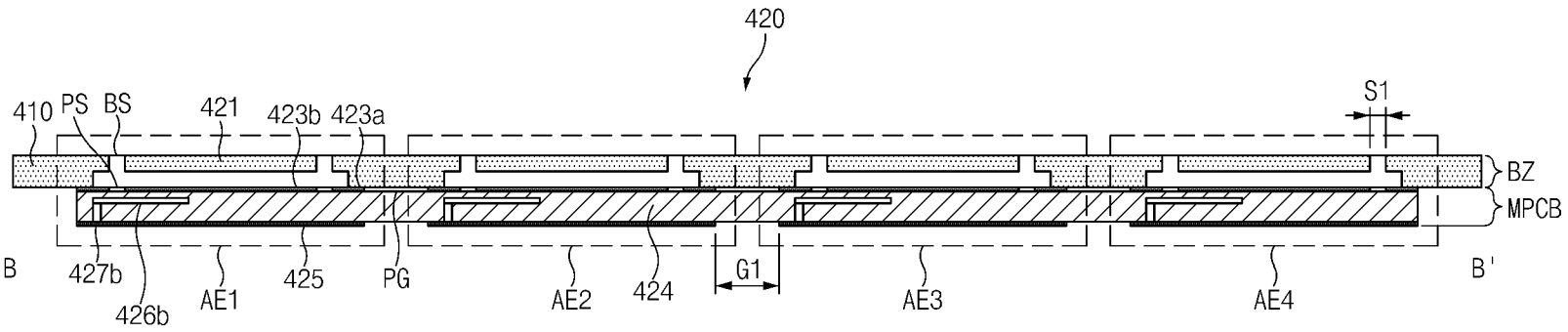
FIG. 4C is a cross-sectional view taken along a line B-B' of FIG. 4A.
Figure 4D:
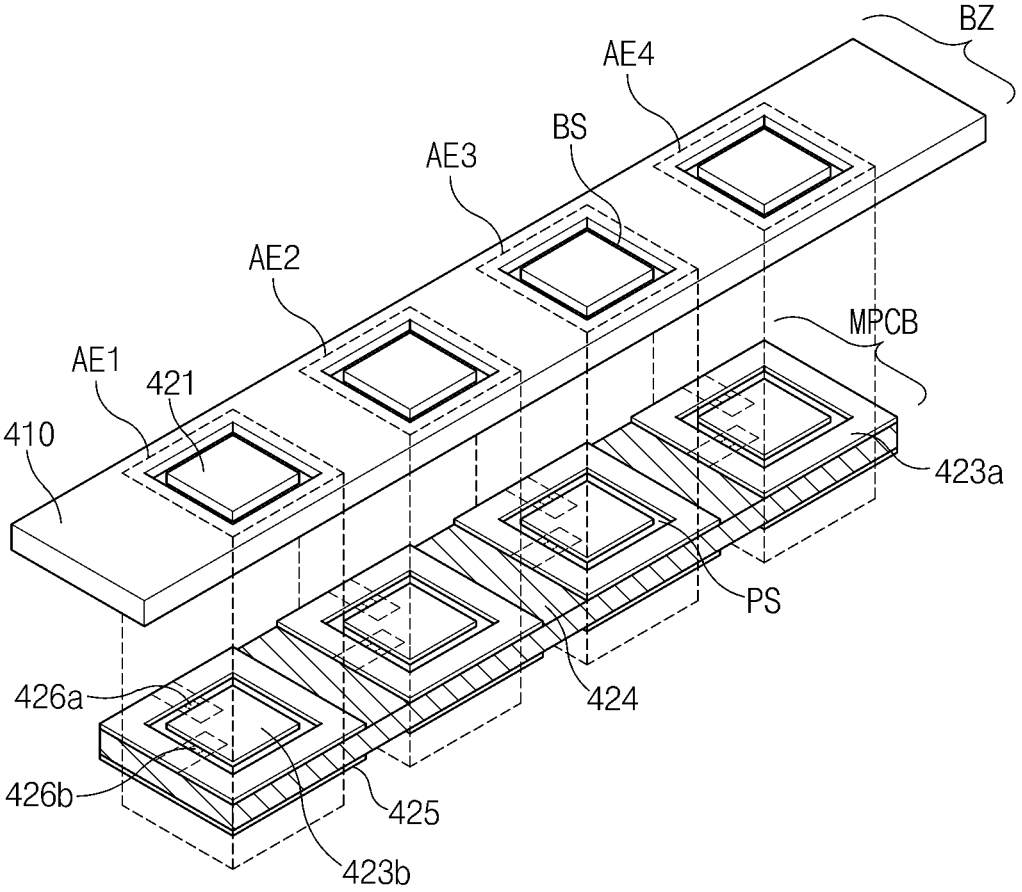
FIG. 4D is a view illustrating the antenna module of FIG. 4A when viewed from one side.
Figure 4E:
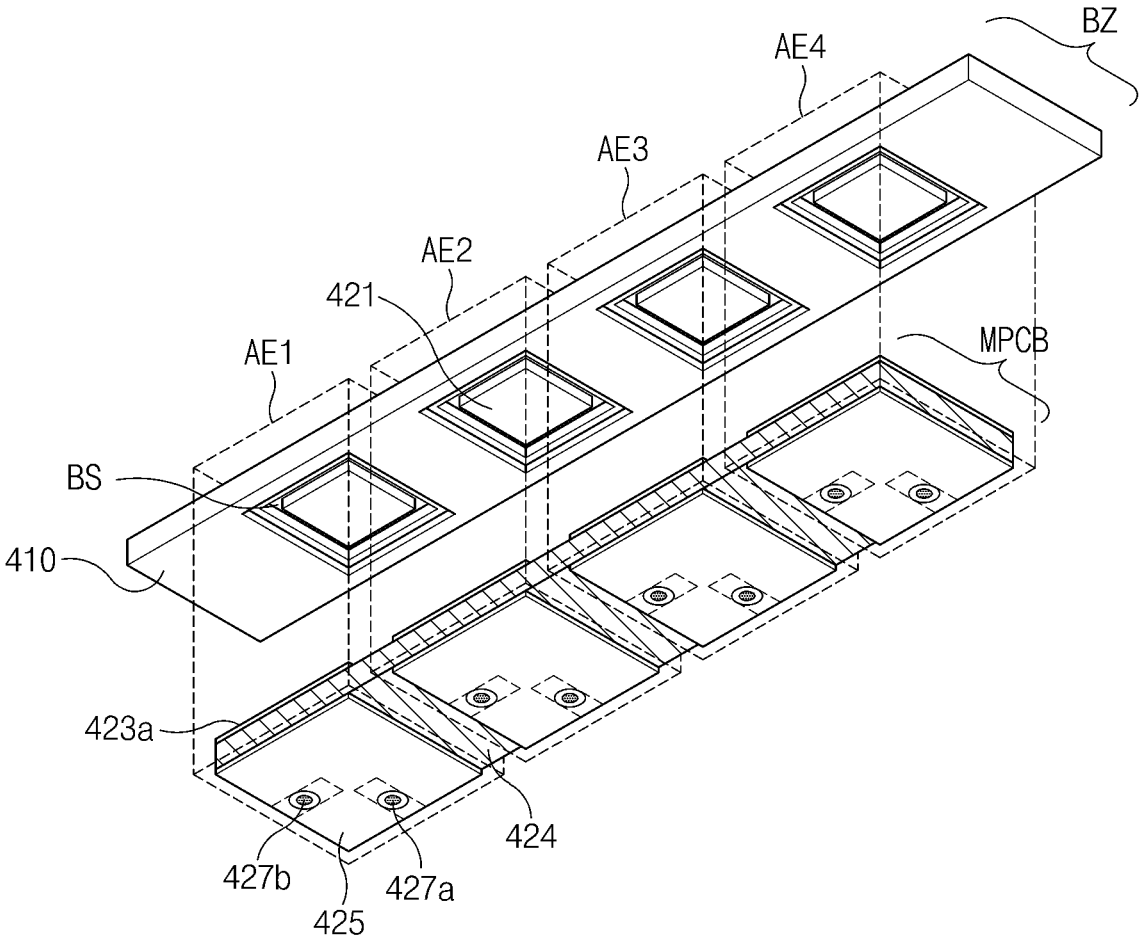
FIG. 4E is a view illustrating the antenna module of FIG. 4A when viewed from another side.

FIG. 4A is a view illustrating a structure of an antenna module, according to an embodiment of the disclosure. FIG. 4B is a cross-sectional view taken along a line A-A' of FIG. 4A. FIG. 4C is a cross-sectional view taken along a line B-B' of FIG. 4A. FIG. 4D is a view illustrating the antenna module of FIG. 4A when viewed from one side. FIG. 4E is a view illustrating the antenna module of FIG. 4A when viewed from another side.

According to an embodiment, an antenna module 420 (e.g., the first antenna 320) may be disposed on a portion of a metal bezel 410 (e.g., the side bezel structure 310). The antenna module 420 may include a bezel portion BZ and a module PCB portion MPCB. The module PCB portion MPCB may be disposed under the bezel portion BZ.

According to an embodiment, the bezel portion BZ may include a bezel patch 421 and a bezel cavity 422. For purposes of this document, "include" shall refer to, in addition to it plain and ordinary meaning, a circumstance where first element has an opening and a second element is in the opening, where there is a narrow space separating the second element from the first element on all sides such that the second element does not make contact with the first element.

For example, the bezel patch 421 may be formed of the same or similar material as the metal bezel 410. The bezel patch 421 may be spaced from the metal bezel 410 through a bezel slit BS. Although in the displayed embodiment, the bezel slit BS completely surrounds the bezel patch, in other embodiments, the bezel patch 421 may be connected to the metal bezel 410 by at least portion in the path of the bezel split BS. The bezel patch 421 may be spaced from the metal bezel 410 by a first slit size S1. For example, the size of the bezel slit BS may be formed as about 0.25 mm; the appearance of the metal bezel 410 due to the bezel slit BS may be minimally affected through the bezel patch 421. In some embodiments the slit can have a size that is small enough to be only visible on close inspection.

The bezel cavity 422 may be filled with a dielectric substance vertically supporting the bezel patch 421. The bezel cavity 422 may operate as an electrical cavity in an RF signal. During the transmission and reception of an antenna, the transmitted and received signal may resonate in the bezel cavity 422, and the antenna module 420 may secure antenna performance. The bezel cavity 422 may be formed to have a constant height.

According to an embodiment, the module PCB portion MPCB may include a plurality of layers. For example, the first layer of the module PCB portion MPCB may include a first conductive pattern 423*a* and a second conductive pattern 423*b*. The second conductive pattern 423*b* may be positioned surrounded by the first conductive pattern 423*a*; the first conductive pattern 423*a* and the second conductive pattern 423*b* may be spaced from each other through a substrate slit PS. The bezel slit BS and the substrate slit PS may be arranged by being aligned vertically. The substrate slit PS may have a first slit size S1 the same as the bezel slit BS. The second layer of the module PCB portion MPCB may include a ground pattern 425. The ground pattern 425 and the first conductive pattern 423*a* may be arranged by being aligned vertically.

According to an embodiment, a first feed part 426*a* (e.g., vertical feed part) and a second feed part 426*b* (e.g., horizontal feed part) may be interposed between the first layer and the second layer of the module PCB portion MPCB. For example, the first feed part 426*a* and the second feed part 426*b* may not be connected to the first conductive pattern 423*a* and the second conductive pattern 423*b*. The first feed part 426*a* and second feed part 426*b* may feed the substrate slit PS in the coupling scheme.

According to an embodiment, the first feed part 426*a* may be disposed in a direction perpendicular to the second feed part 426*b*. For example, the first feed part 426*a* may be disposed perpendicular to the first side surface of the bezel patch 421; the second feed part 426*b* may be disposed perpendicular to the second side surface of the bezel patch 421 perpendicular to the first side surface. During the operation of an antenna, the first feed part 426*a* may form the radiation component of vertical polarization; the second feed part 426*b* may form the radiation component of horizontal polarization.

According to an embodiment, the first feed part 426*a* may be connected to the RF IC through a first feed via 427*a*. The second feed part 426*b* may be connected to an RF IC through a second feed via 427*b*. Alternatively, the first feed via 427*a* and the second feed via 427*b* may be connected to the RF IC through additional wiring. The module PCB portion MPCB may include a circuit (e.g., the antenna module 197) for communication including the RF IC.

According to an embodiment, the antenna module 420 may include at least one antenna array. The antenna array may include a plurality of antenna elements AE1, AE2, AE3, and AE4. For example, a plurality of antenna elements AE1, AE2, AE3, and AE4 may be disposed on the metal bezel 410 in a line. Each of the antenna elements AE1, AE2, AE3, and AE4 may include the same configuration and may be formed in the same size. However, the configuration and size of the antenna elements AE1, AE2, AE3, and AE4 are not limited thereto.

According to an embodiment, the metal bezel 410 of the antenna elements AE1, AE2, AE3, and AE4 may be formed to be connected integrally. The bezel patch 421 or bezel cavity 422 of each of the antenna elements AE1, AE2, AE3, and AE4 may be formed to be separated from each other. The first feed part 426*a* or the ground pattern 425 of each of the antenna elements AE1, AE2, AE3, and AE4 may be formed to be separated from each other through a pattern gap PG. The first feed part 426*a* or the ground pattern 425 of each of the antenna elements AE1, AE2, AE3, and AE4 may be disposed spaced from each other by a first pattern gap size G1.

According to an embodiment, the bezel cavity 422 of each of the antenna elements AE1, AE2, AE3, and AE4 may be formed inside the metal bezel 410. Accordingly, only the bezel slit BS is observed outside the metal bezel 410; the bezel cavity 422 does not affect the appearance of the metal bezel 410.

According to an embodiment, the resonant frequency of the antenna signal may vary depending on the widths of the bezel slit BS or the substrate slit PS. The resonant frequency of the antenna signal may be changed depending on the sizes of the bezel patch 421 or the second conductive pattern 423*b*. The resonant frequency of the antenna signal may be changed depending on the size of the bezel cavity 422.

As described above, in an electronic device (e.g., the electronic device 200) according to certain embodiments, the antenna module 420 may be disposed on the metal bezel 410. The antenna module 420 may include the bezel patch 421 separated from the metal bezel 410 through the bezel slit BS. The bezel cavity 422 may be formed inside the metal bezel 410 to secure antenna performance. Accordingly, the antenna performance may be secured through the bezel cavity 422; because the bezel slit BS is capable of being implemented with very small width, the electronic device may arrange the antenna module 420 while minimizing the effect on the appearance of the metal bezel 410.

Figure 5A:
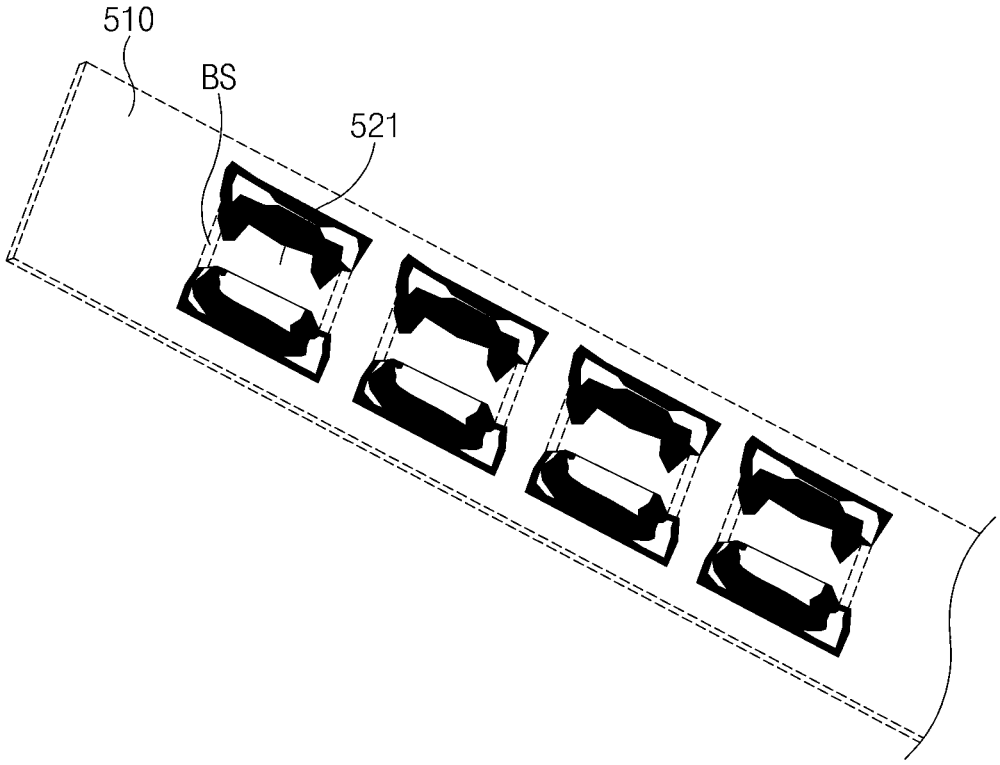
FIG. 5A is a view illustrating a radiation operation of the antenna module of FIG. 4A.
Figure 5B:
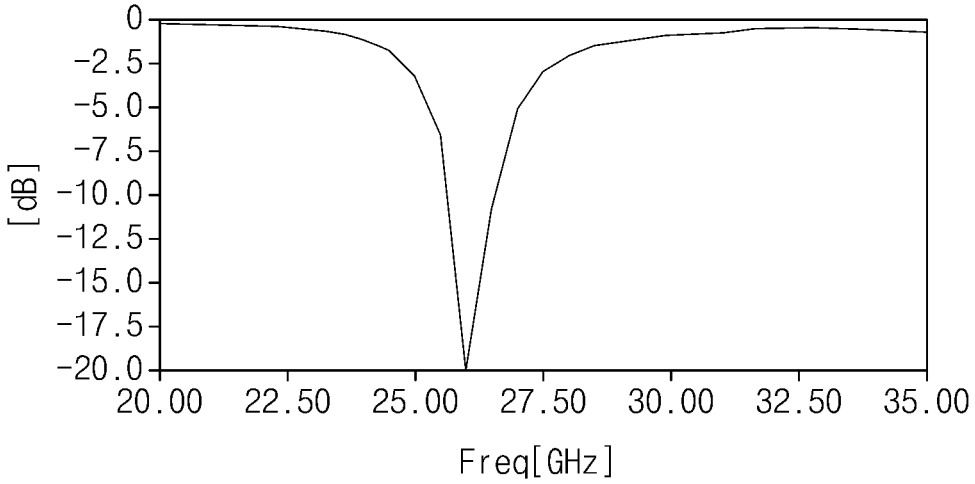
FIG. 5B is a view illustrating a resonance effect of the antenna module of FIG. 4A.
Figure 5C:
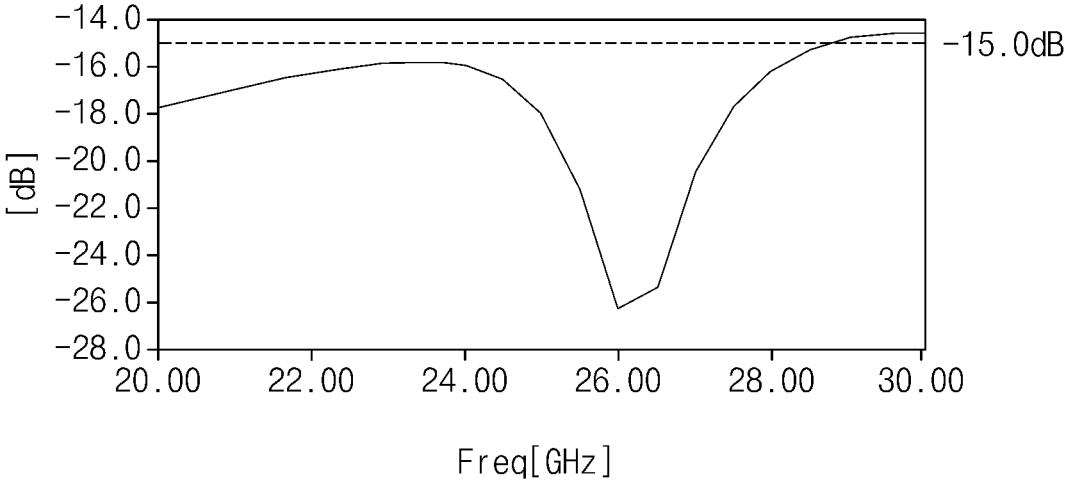
FIG. 5C is a view illustrating a resonance effect between feed parts of the antenna module of FIG. 4A.
Figure 5D:
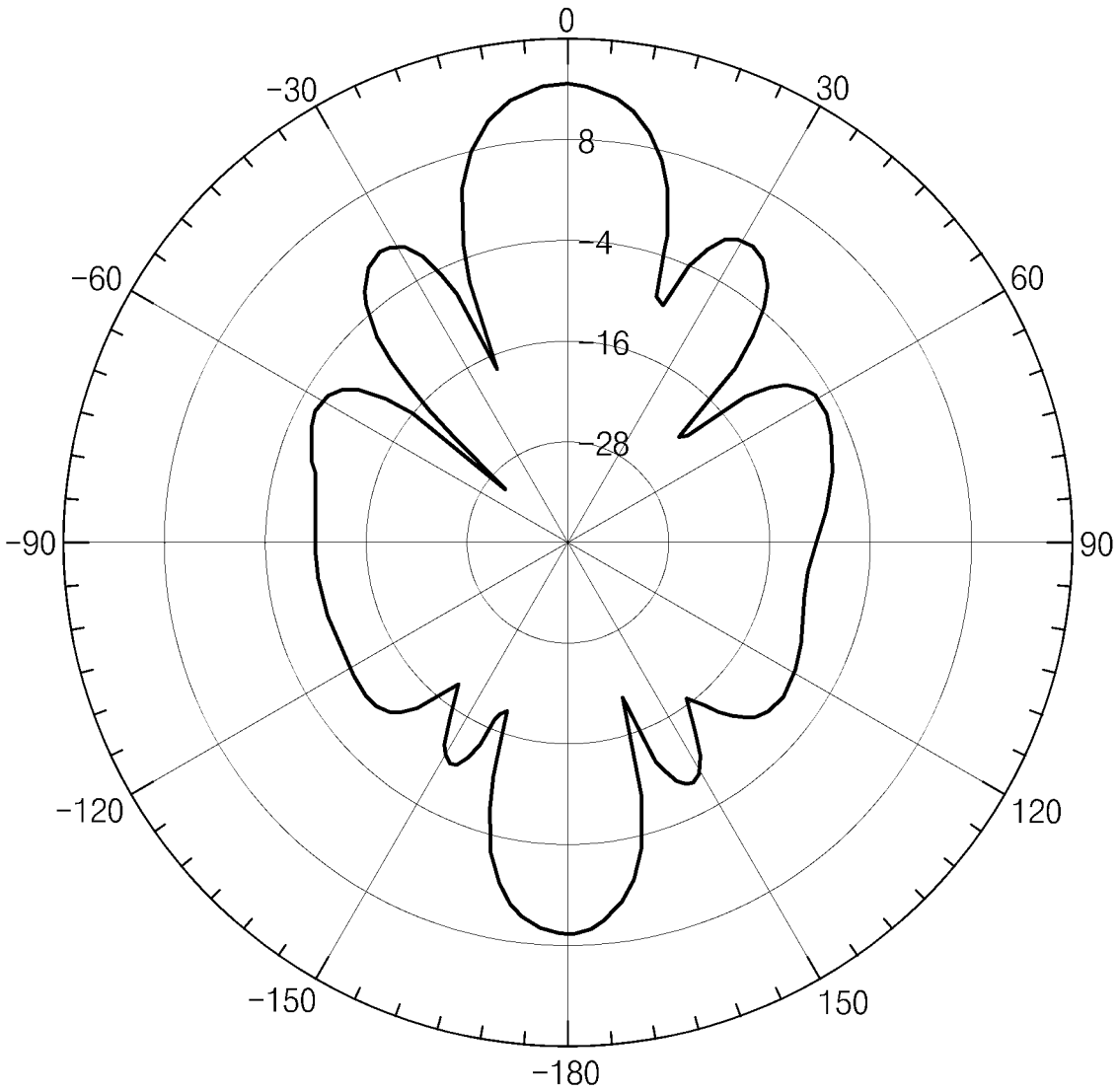
FIG. 5D is a view illustrating transmission and reception performance of the antenna module of FIG. 4A.

FIG. 5A is a view illustrating a radiation operation of the antenna module of FIG. 4A. FIG. 5B is a view illustrating a resonance effect of the antenna module of FIG. 4A. FIG. 5C is a view illustrating a resonance effect between feed parts of the antenna module of FIG. 4A. FIG. 5D is a view illustrating transmission and reception performance of the antenna module of FIG. 4A.

Referring to FIGS. 4A to 4E and 5A, when the antenna signal is fed to the first feed part 426*a* and the second feed part 426*b*, the antenna signal may resonate within the bezel cavity 422 and may be radiated through the bezel slit BS. The resonant frequency of the antenna signal may be changed depending on the size of the bezel cavity 422, the size of the bezel patch 421, or the width of the bezel slit BS.

Referring to FIG. 5B, the graph illustrating the result of the radiation simulation for the antenna illustrated in FIG. 4A is illustrated. Referring to the graph, it may be understood that a resonance is formed at around 26.5 GHz. It may be understood that the antenna module 420 may transmit and receive an antenna signal in the band of a high frequency (e.g., about 26.5 GHz) by forming the bezel cavity 422 and the bezel slit BS on the metal bezel 410. For example, referring to Table 1, the antenna module 420 may have a band width of about 2 GHz.

TABLE 1

| Frequency (GHz) | 25.5 | 26.5 | 27.5 |
|---|---|---|---|
| Element gain (dB) | 7.403 | 8.73 | 6.12 |

Referring to FIG. 5C, the graph illustrating the result of the radiation simulation between the first feed part 426*a* and the second feed part 426*b* is illustrated. Referring to the graph, it may be understood that the isolation performance of the antenna module 420 having an S-parameter value of about −15 dB or less over the entire band is specified.

Referring to FIG. 5D, the graph illustrating the radiation pattern of the antenna module 420 is illustrated. Referring to the graph, for example, when the antenna module 420 includes 1×4 antenna elements AE1, AE2, AE3, and AE4, it may be understood that beam forming is formed normally.

TABLE 2

| | Element | Array |
|---|---|---|
| Gain (dB) | 8.74 | 14.6 |

Table 2 illustrates gains in the case of operating as an antenna element and an antenna array. It may be understood that the antenna element gain is greater than the antenna array gain by about 6 dB (4 times) due to the characteristics of the 1×4 antenna array.

Figure 6A:
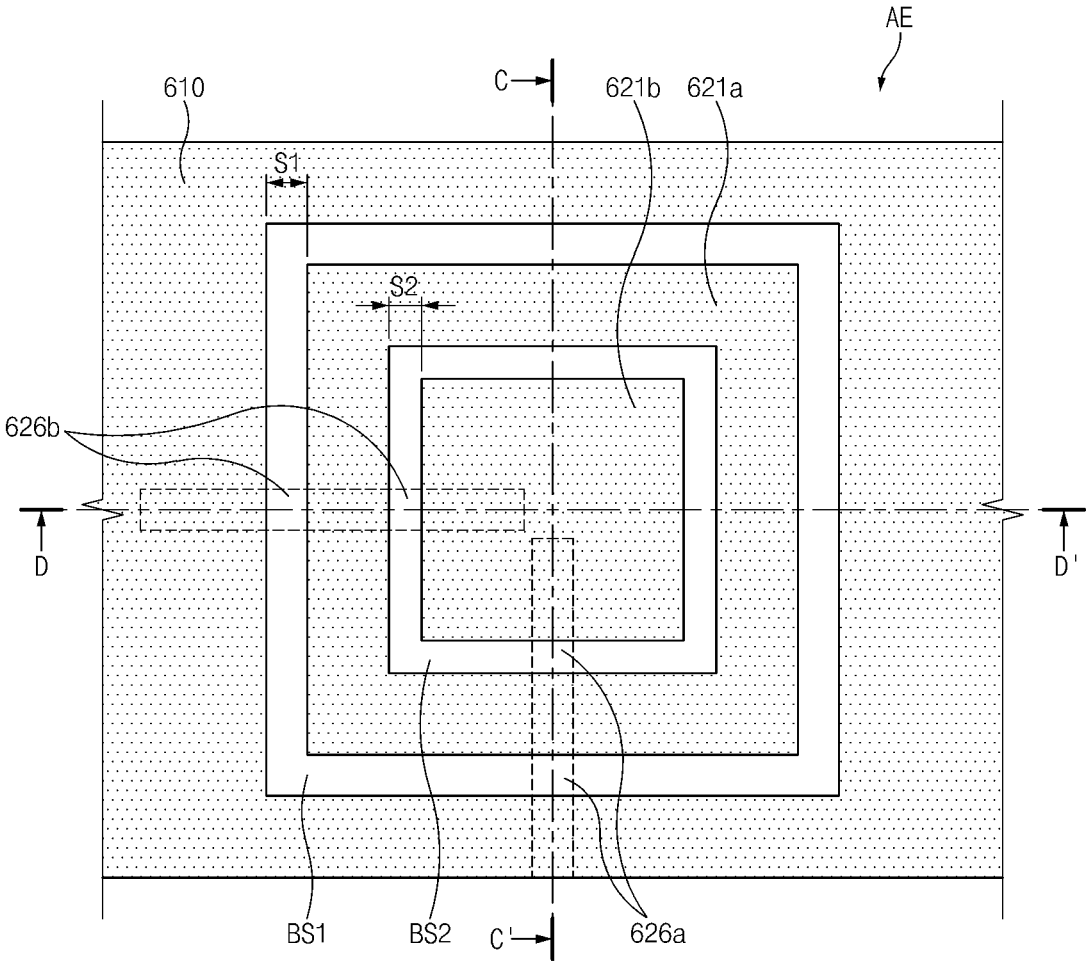
FIG. 6A is a view illustrating a structure of an antenna module, according to another embodiment of the disclosure.
Figure 6B:
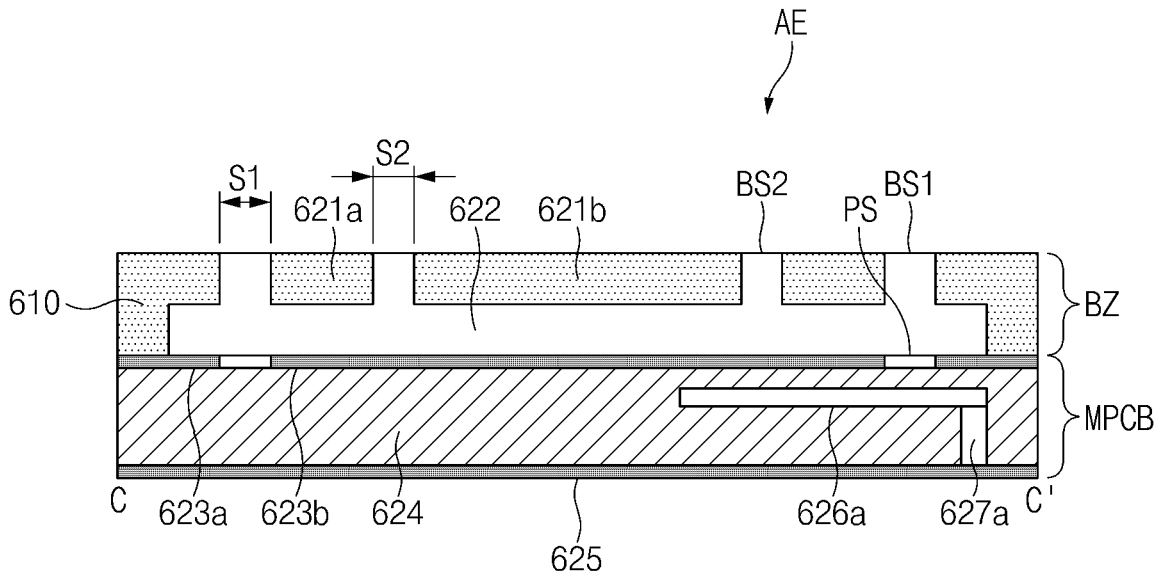
FIG. 6B is a sectional view taken along a line C-C' of FIG. 6A.
Figure 6C:
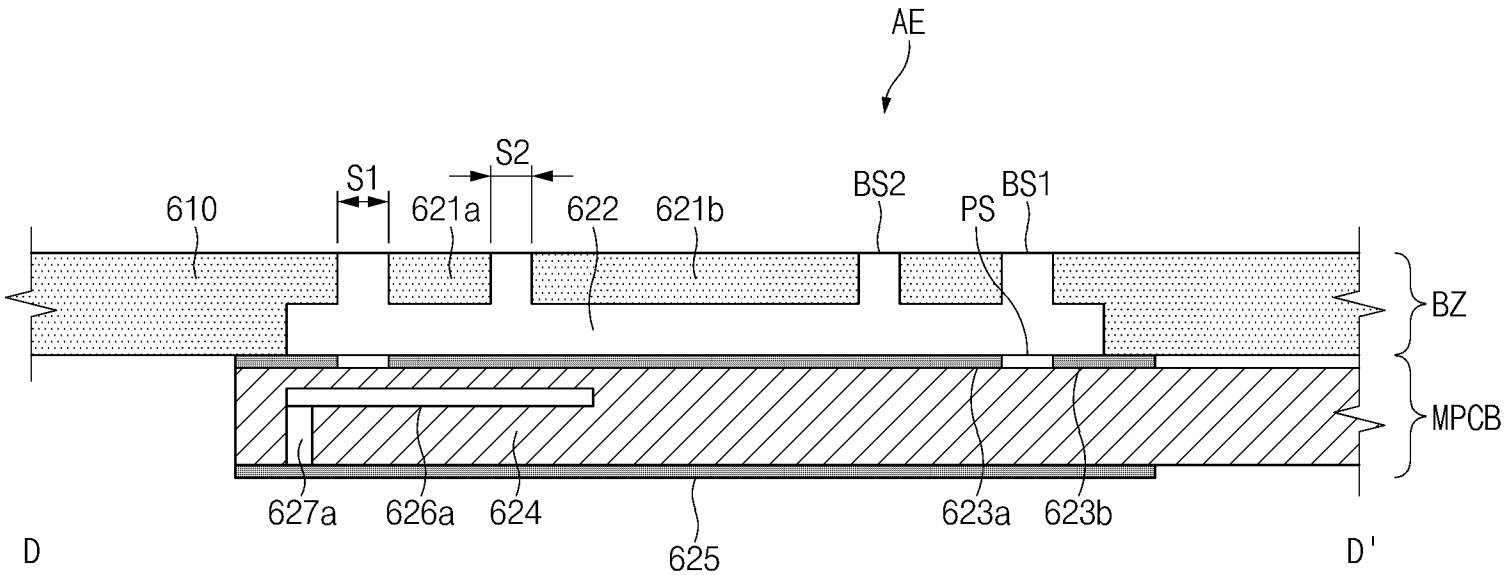
FIG. 6C is a sectional view taken along a line D-D' of FIG. 6A.

FIG. 6A is a view illustrating a structure of an antenna module, according to another embodiment of the disclosure. FIG. 6B is a sectional view taken along a line C-C' of FIG. 6A. FIG. 6C is a sectional view taken along a line D-D' of FIG. 6A.

Referring to FIGS. 6A to 6C, a single antenna element AE included in an antenna module (e.g., the antenna module 420) is illustrated. The description about the configuration the same as or similar to that of the first antenna element AE1 of FIGS. 4A to 4E will be omitted.

According to an embodiment, the antenna element AE may include the bezel portion BZ and the module PCB portion MPCB. The module PCB portion MPCB may be disposed under the bezel portion BZ.

According to an embodiment, the bezel portion BZ may include at least one bezel slit. For example, the bezel portion BZ may include first and second bezel slits BS1 and BS2. The bezel portion BZ may include a outer bezel patch 621*a* and an inner bezel patch 621*b*, which are separated through the first and second bezel slits BS1 and BS2. The outer bezel patch 621*a* and the inner bezel patch 621*b* may be formed of the same or similar material as a metal bezel 610. The antenna module may operate (e.g., two different resonance frequencies) at the resonant frequency corresponding to the number of bezel slits (e.g., two) included in the antenna element.

According to an embodiment, the outer bezel patch 621*a* and the inner bezel patch 621*b* may have different sizes from each other. For example, the length of one side of the outer bezel patch 621*a* may be different from the length of one side of the inner bezel patch 621*b*. The length of one side of the outer bezel patch 621*a* may be greater than the length of one side of the inner bezel patch 621*b*. The resonant frequency of the antenna module may be changed depending on the lengths of sides of the outer bezel patch 621*a* and the inner bezel patch 621*b*.

According to an embodiment, the first and second bezel slits BS1 and BS2 may have different sizes from each other. For example, the outer bezel patch 621*a* may be spaced from the metal bezel 610 by a first slit size S1. The inner bezel patch 621*b* may be spaced from the outer bezel patch 621*a* by a second slit size S2. The inner bezel patch 621*b* may be disposed inside the outer bezel patch 621*a*. The outer bezel patch 621*a* and the inner bezel patch 621*b* may share a center. In an embodiment, the second slit size S2 may be smaller than the first slit size S1. The resonant frequency of the antenna module may be changed depending on the first and second slit sizes S1 and S2.

According to an embodiment, the bezel portion BZ may include a bezel cavity 622. For example, the bezel cavity 622 may be filled with a dielectric substance providing vertical support for the outer bezel patch 621*a* and inner bezel patch 621*b*. The bezel cavity 622 may operate as an electrical cavity in an RF signal. During the transmission and reception of an antenna, the transmitted and received signal may resonate in the bezel cavity 622, and the antenna module may secure antenna performance. The bezel cavity 622 may be formed to have a constant height.

According to an embodiment, the module PCB portion MPCB may include a plurality of layers. For example, the first layer of the module PCB portion MPCB may include a first conductive pattern 623*a* and a second conductive pattern 623*b*. The second conductive pattern 623*b* may be positioned surrounded by the first conductive pattern 623*a*; the first conductive pattern 623*a* and the second conductive pattern 623*b* may be spaced from each other through a substrate slit PS. The substrate slit PS may be disposed at a location corresponding to the first bezel slit BS1. The substrate slit PS may have a first slit size S1 the same as the bezel slit BS. The second layer of the module PCB portion MPCB may include a ground pattern 625.

Figure 7A:
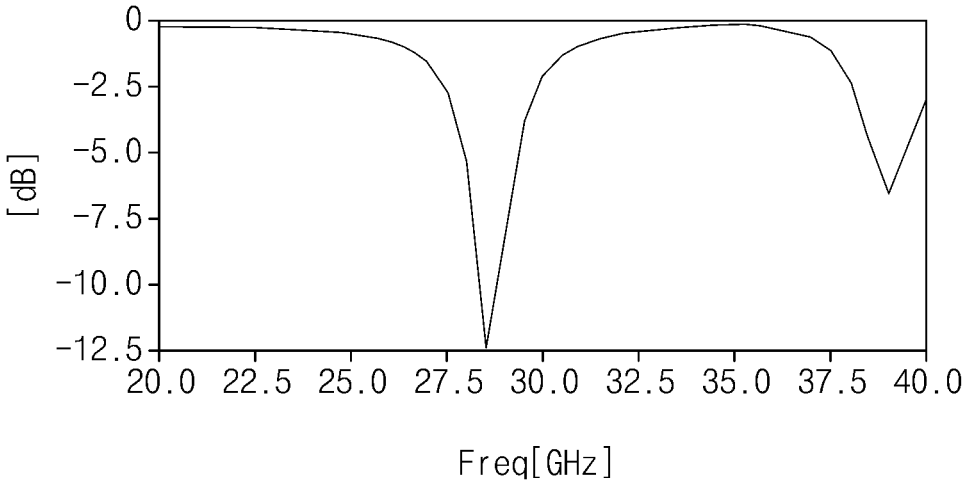
FIG. 7A is a view illustrating a resonance effect of the antenna module of FIG. 6A.
Figure 7B:
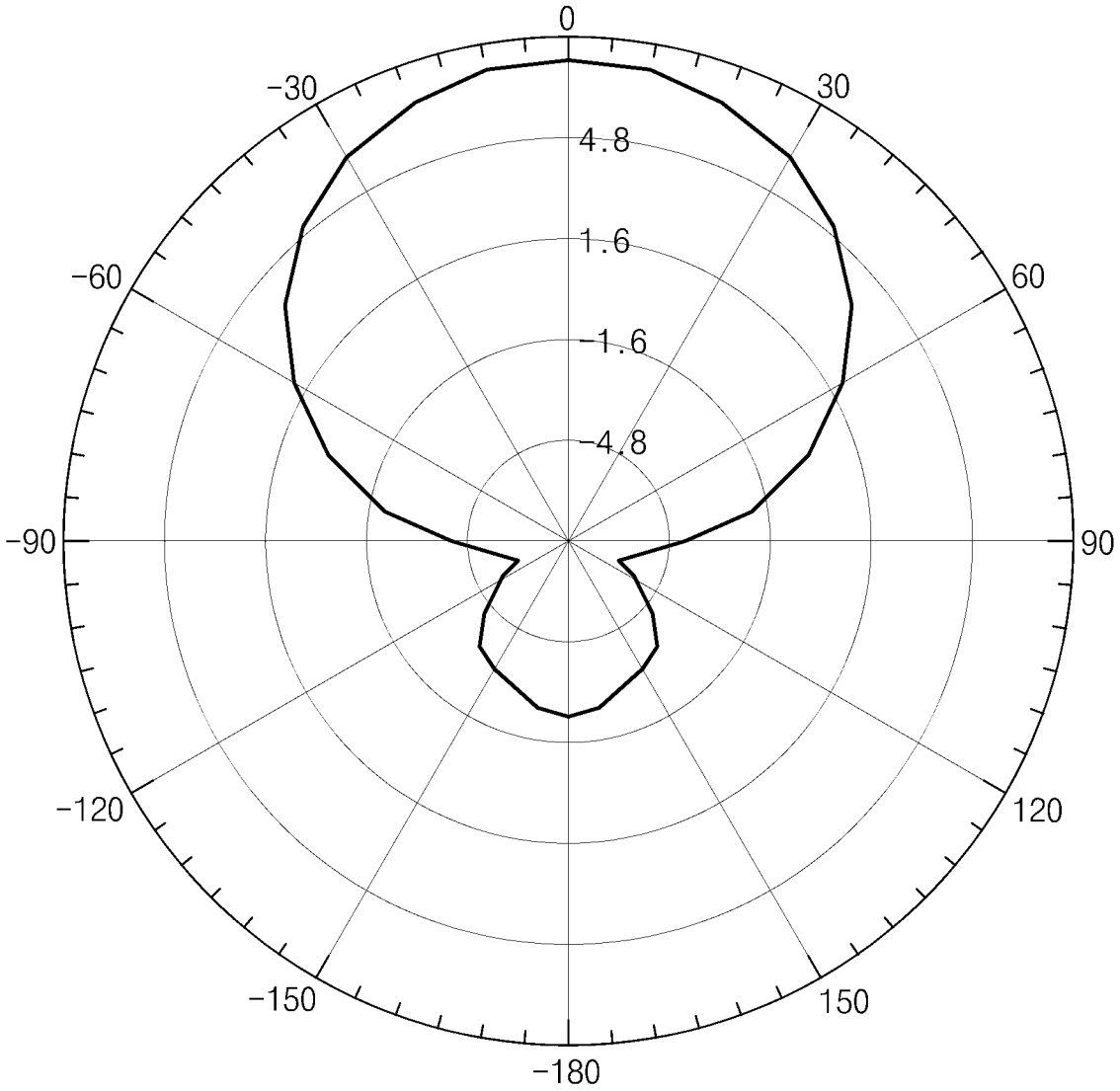
FIG. 7B is a view illustrating the first transmission and reception performance of the antenna module of FIG. 6A.
Figure 7C:
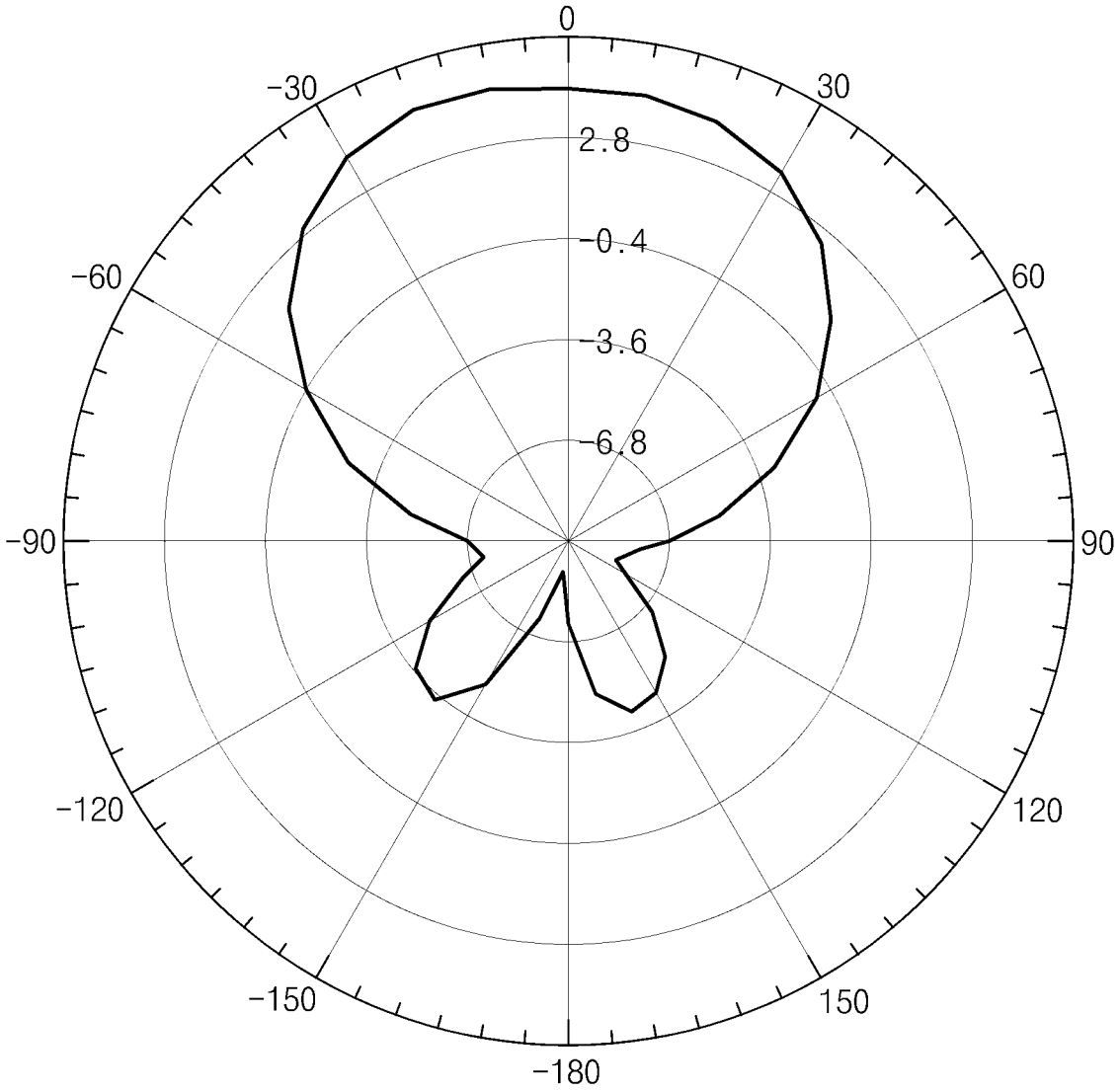
FIG. 7C is a view illustrating the second transmission and reception performance of the antenna module of FIG. 6A.

FIG. 7A is a view illustrating a resonance effect of the antenna module of FIG. 6A. FIG. 7B is a view illustrating the first transmission and reception performance of the antenna module of FIG. 6A. FIG. 7C is a view illustrating the second transmission and reception performance of the antenna module of FIG. 6A. When the antenna signal is fed to a first feed part 626*a* and a second feed part 626*b*, the antenna signal may resonate within the bezel cavity 622 and may be radiated through the bezel slit BS. The resonant frequency of the antenna signal may be changed depending on the size of the bezel cavity 622, the sizes of the outer bezel patch 621*a* and the inner bezel patch 621*b*, or the widths of the first and second bezel slits BS1 and BS2. In addition, because a single antenna element AE includes two bezel slits BS1 and BS2, two resonant frequencies may be identified in the graph.

Referring to FIG. 7A, the graph illustrating the result of the radiation simulation for the antenna module illustrated in FIG. 6A is illustrated. Referring to the graph, it may be understood that a resonance is formed at around 28.5 GHz and 38.5 GHz. It may be understood that an antenna module 620 may transmit and receive an antenna signal in two frequency bands (e.g., about 28.5 GHz and about 38.5 GHz) by forming the bezel cavity 622 and the two bezel slits BS1 and BS2 on the metal bezel 610.

Referring to FIGS. 7B and 7C, the graph illustrating the result of the radiation pattern for the antenna module illustrated in FIG. 6A is illustrated. Referring to the graph, for example, FIG. 7B illustrates the radiation pattern in a low band (e.g., about 28.5 GHz); FIG. 7C illustrates the radiation pattern in a high band (e.g., about 38.5 GHz); it may be seen that beam forming is normally formed.

TABLE 3

| Frequency (GHz) | 28.5 | 38.5 |
|---|---|---|
| Gain (dB) | 7.48 | 5.15 |

Table 3 illustrates the antenna element gain of the antenna module 620 in the dual band (e.g., about 28.5 GHz and 38.5 GHz) illustrated in FIG. 6A. According to the antenna element gain, it may be seen that the antenna module illustrated in FIG. 6A operates normally as a dual band.

Figure 8:
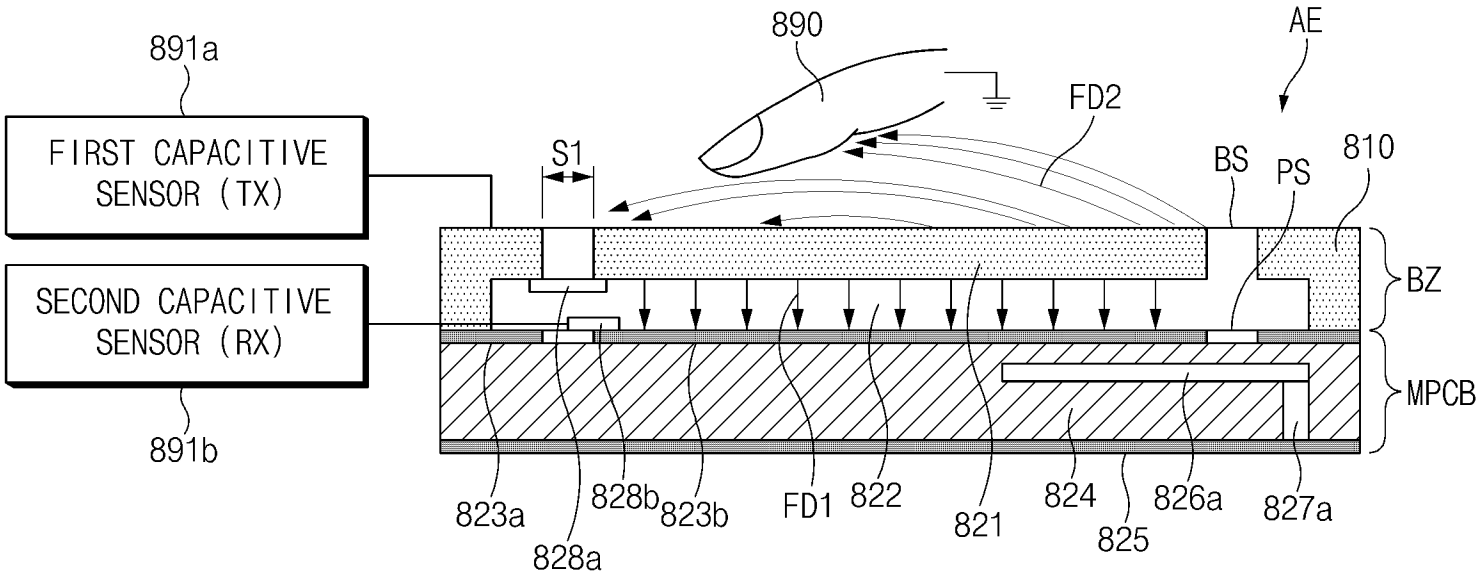
FIG. 8 is a diagram illustrating a structure of an antenna module used as a switch, according to an embodiment of the disclosure.

FIG. 8 is a diagram illustrating a structure of an antenna module used as a switch, according to an embodiment of the disclosure.

Referring to FIG. 8, the antenna element AE may include a first inductor 828*a* and a second inductor 828*b*. In the antenna element AE, the description about the configuration having the structure the same as or similar to that of the first antenna element AE1 of FIGS. 4A to 4E will be omitted.

According to an embodiment, the first inductor 828*a* may be connected between a metal bezel 810 and a bezel patch 821. The second inductor 828*b* may be connected to a second conductive pattern 823*b*. A first capacitive sensor 891*a* (e.g. a capacitive transmission sensor) may be connected to the metal bezel 810. A second capacitive sensor 891*b* (e.g. a capacitive reception sensor) may be connected to the second inductor 828*b*. The first capacitive sensor 891*a* may transmit a sensor signal, and the second capacitive sensor 891*b* may detect the strength of the sensor signal. The low-frequency signal may be used as the sensor signal rather than the antenna signal so as to pass through the first inductor 828*a* and the second inductor 828*b*. Because the antenna signal is a relatively high-frequency signal, the antenna signal may not pass through the first inductor 828*a* and the second inductor 828*b*. According to an embodiment, the inductance values of the first inductor 828*a* and the second inductor 828*b* may be designed based on the frequencies of the antenna signal and the sensor signal.

According to an embodiment, when the first capacitive sensor 891*a* applies the sensor signal, a first electric field FD1 may occur between the bezel patch 821 and the second conductive pattern 823*b*. When a dielectric substance 890 (e.g., the finger of a human) contacts the bezel patch 821, a second electric field FD2 may occur and the first electric field FD1 may decrease. The second capacitive sensor 891*b* may generate a switch signal by detecting the increase or decrease of the first electric field FD1. For example, when the strength of the first electric field FD1 is reduced to the threshold value or less, an electronic device may determine that the dielectric substance 890 is touched. Accordingly, the electronic device may utilize an antenna module as a switch.

According to an embodiment, when the dielectric substance 890 is touched to the antenna element AE, the electronic device may stop utilizing the antenna array including the antenna element AE and may use the antenna array mounted at another location. Alternatively, when the dielectric substance 890 is touched to the antenna element AE, the electronic device may stop utilizing the touched antenna element AE and may perform communication using another antenna element.

Figure 9A:
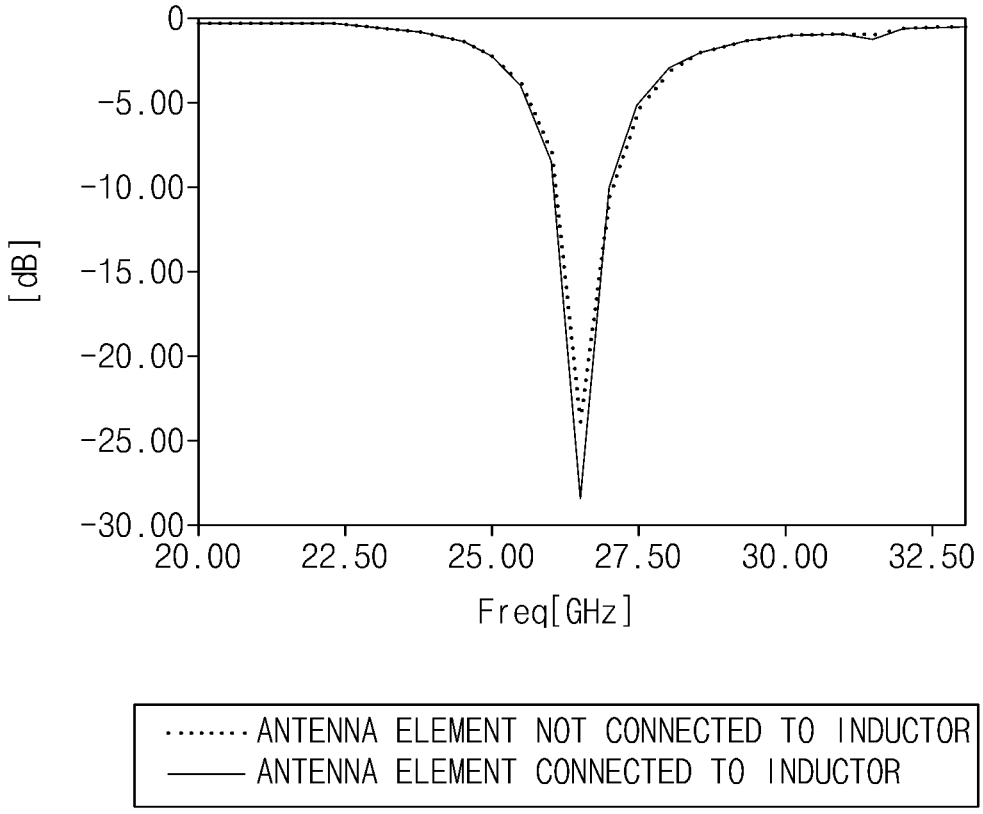
FIG. 9A is a view illustrating a resonance effect of the antenna module of FIG. 8.
Figure 9B:
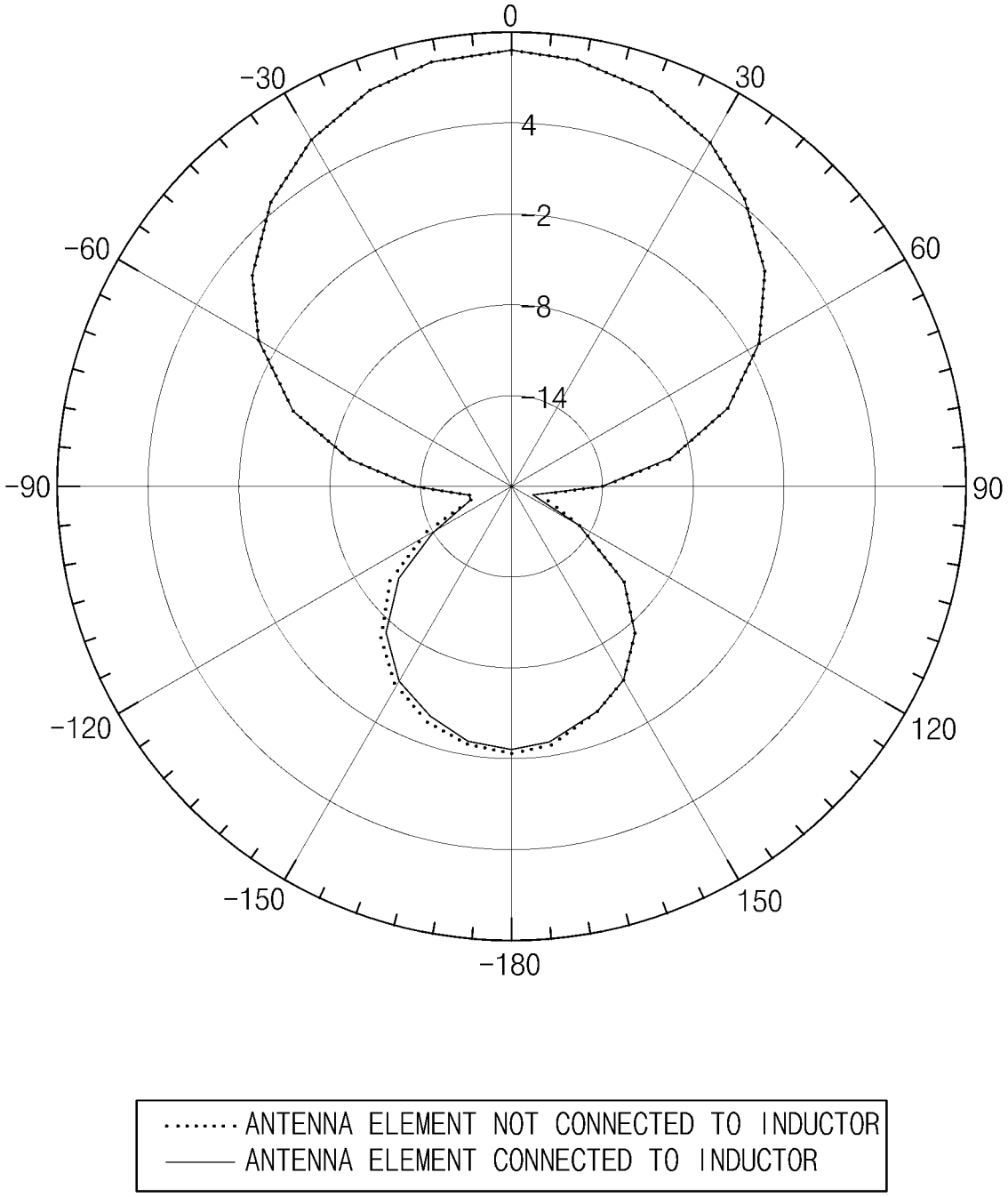
FIG. 9B is a view illustrating the transmission and reception performance of the antenna module of FIG. 8.

FIG. 9A is a view illustrating a resonance effect of the antenna module of FIG. 8. FIG. 9B is a view illustrating the transmission and reception performance of the antenna module of FIG. 8.

FIGS. 9A and 9B are graphs illustrating the effect of performance when an inductor is connected to an antenna element. Referring to FIGS. 9A and 9B, it may be seen that there is minimal, if not no difference in antenna performance between the case where the inductor is connected to the antenna element (e.g., the case where the antenna element is used as a touch switch) and the case where the inductor is not connected to the antenna element (e.g., the case where the antenna element is not used as a touch switch).

Figure 10A:
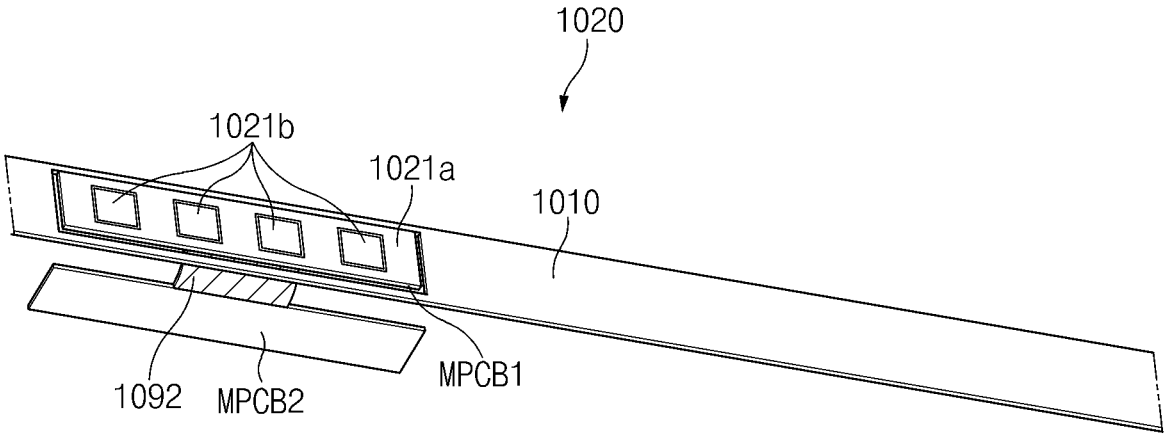
FIGS. 10A and 10B are diagrams illustrating a structure of an antenna module used as a switch, according to another embodiment of the disclosure.
Figure 10B:
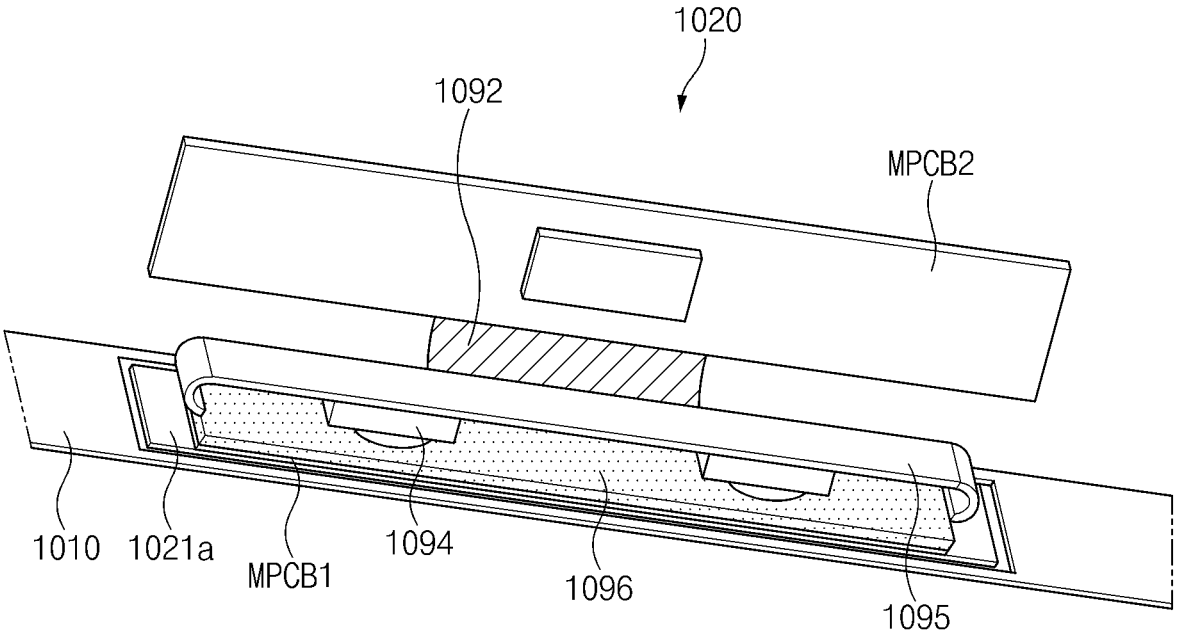

FIGS. 10A and 10B are diagrams illustrating a structure of an antenna module used as a switch, according to another embodiment of the disclosure.

According to an embodiment, an antenna module 1020 may be used as a physical switch. The antenna module 1020 may include a first bezel patch 1021*a* (e.g., a switch bezel patch) and a second bezel patch 1021*b* (e.g., the bezel patch 421). The first bezel patch 1021*a* may be configured to perform a switching operation while being separated from a metal bezel 1010 through a switch separation slit. The first bezel patch 1021*a* may be combined with a tact switch 1094 to operate as the physical switch. The second bezel patch 1021*b* may be distinguished from the first bezel patch 1021*a* through a bezel slit (e.g., the bezel slit BS).

According to an embodiment, a module PCB portion may include a first module PCB portion MPCB1 (e.g., a module printed circuit board) and a second module PCB portion MPCB2 (e.g., a control printed circuit board). The first module PCB portion MPCB1 and the first bezel patch 1021*a* may be arranged to be aligned vertically. The first module PCB portion MPCB1 may include first and second conductive patterns (e.g., first and second conductive patterns 423*a* and 423*b*), a ground pattern (e.g., the ground pattern 425), and first and second feed parts (e.g., the first and second feed parts 426*a* and 426*b*). The first module PCB portion MPCB1 may be interposed between the first bezel patch 1021*a* and the tact switch 1094. The second module PCB portion MPCB2 may be connected to the first module PCB portion MPCB1 through a flexible printed circuit board (FPCB) 1092. The second module PCB portion MPCB2 may include a circuit (e.g., the antenna module 197) for communication including an RF IC.

According to an embodiment, the antenna module 1020 may include a switch support member 1095 and a substrate reinforcement member 1096. The tact switch 1094 may be mounted in the switch support member 1095. The tact switch 1094 may be fixed to the first module PCB portion MPCB1 through the switch support member 1095. The substrate reinforcement member 1096 may be interposed between the first module PCB portion MPCB1 and the tact switch 1094. The substrate reinforcement member 1096 may supplement the stiffness of the first module PCB portion MPCB1.

Figure 11:
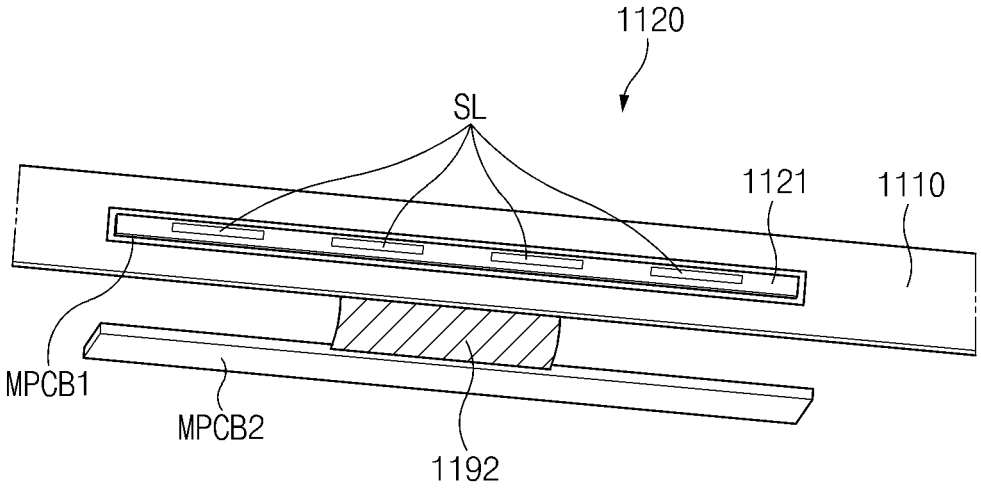
FIG. 11 is a diagram illustrating a structure of an antenna module used as a switch, according to still another embodiment of the disclosure.

FIG. 11 is a diagram illustrating a structure of an antenna module used as a switch, according to still another embodiment of the disclosure.

According to an embodiment, an antenna module 1120 may be used as a physical switch. The antenna module 1120 may be implemented with a slit antenna. The antenna module 1120 may include a switch bezel patch 1121; an antenna slit SL may be formed in the switch bezel patch 1121. The switch bezel patch 1121 may operate as a physical switch in combination with a tact switch (e.g., the tact switch 1094).

According to an embodiment, a module PCB portion may include the first module PCB portion MPCB1 and the second module PCB portion MPCB2. The first module PCB portion MPCB1 may be interposed between the switch bezel patch 1121 and a tact switch. The second module PCB portion MPCB2 may be connected to the first module PCB portion MPCB1 through a FPCB 1192. The second module PCB portion MPCB2 may include a circuit (e.g., the antenna module 197) for communication including an RF IC.

According to an embodiment, the antenna module 1120 may include a switch support member (e.g., the switch support member 1095) and a substrate reinforcement member (e.g., a substrate reinforcement member 1096). The tact switch may be mounted in the switch support member. The tact switch may be fixed to the first module PCB portion MPCB1 through the switch support member. The substrate reinforcement member may be interposed between the first module PCB portion MPCB1 and the tact switch. The substrate reinforcement member may supplement the stiffness of the first module PCB portion MPCB1.

Figure 12A:
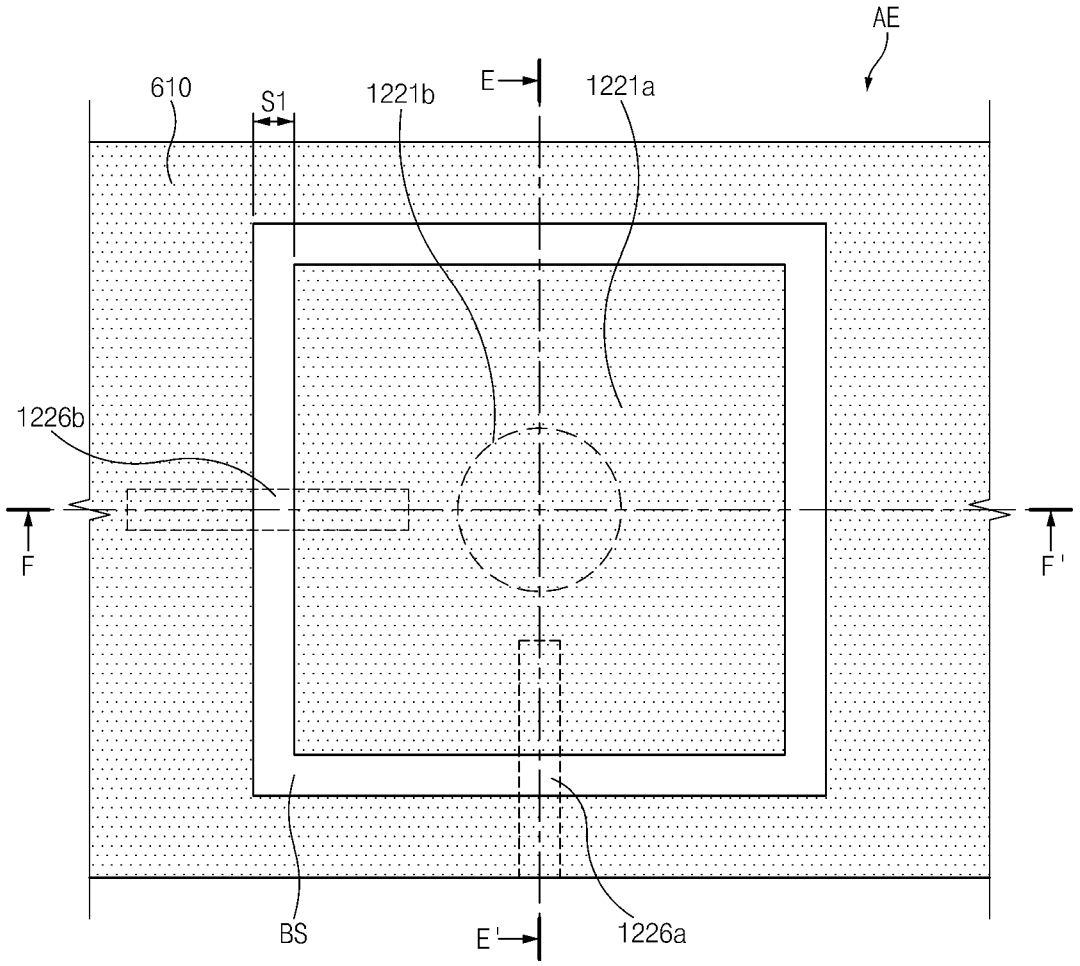
FIG. 12A is a view illustrating a structure of an antenna module including a support structure, according to an embodiment of the disclosure.
Figure 12B:
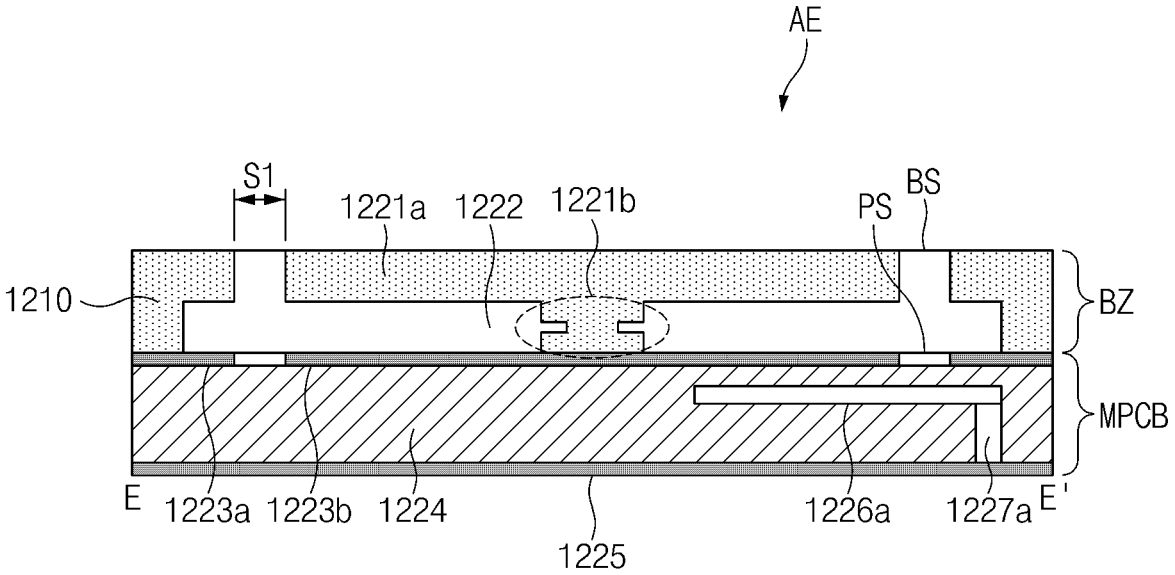
FIG. 12B is a sectional view taken along a line E-E' of FIG. 12A.
Figure 12C:
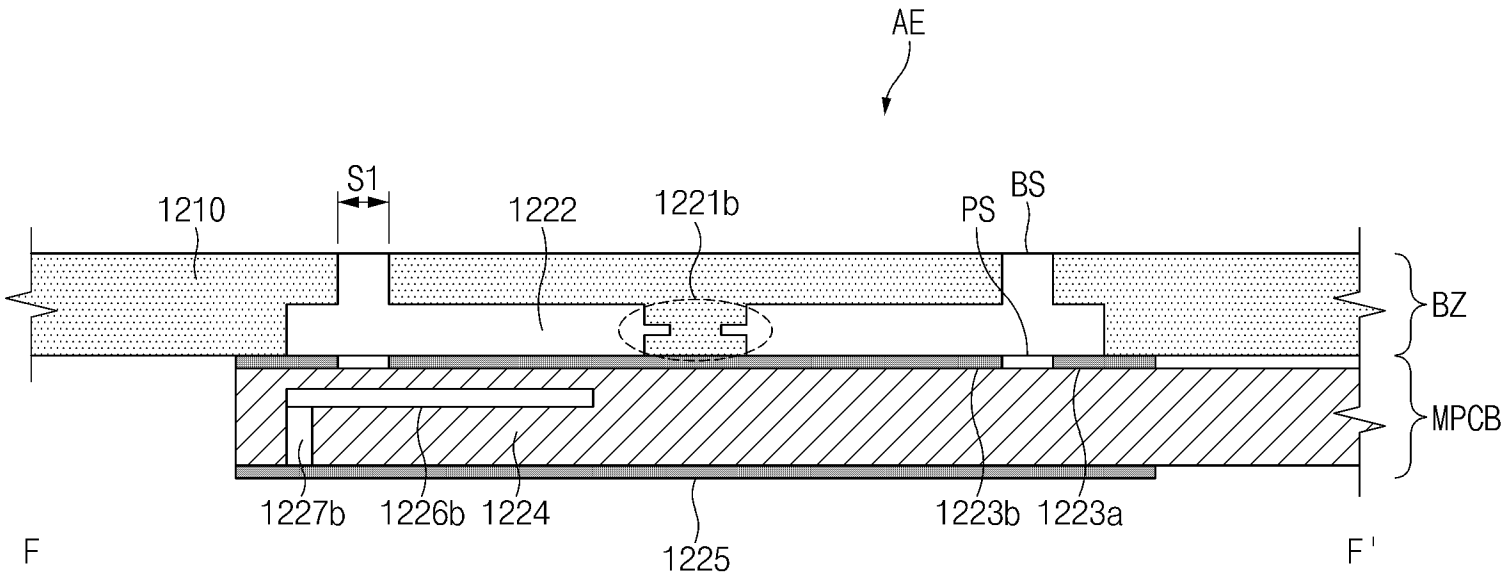
FIG. 12C is a sectional view taken along a line F-F' of FIG. 12A.

FIG. 12A is a view illustrating a structure of an antenna module including a support structure, according to an embodiment of the disclosure. FIG. 12B is a sectional view taken along a line E-E' of FIG. 12A. FIG. 12C is a sectional view taken along a line F-F' of FIG. 12A.

Referring to FIGS. 12A to 12C, a single antenna element AE included in an antenna module (e.g., the antenna module 420) is illustrated. The description about the configuration the same as or similar to that of the first antenna element AE1 of FIGS. 4A to 4E will be omitted.

According to an embodiment, the antenna element AE may include a bezel patch 1221*a* and an injection coupling part 1221*b*. The bezel patch 1221*a* and the injection coupling part 1221*b* may be formed integrally. For example, the injection coupling part 1221*b* may be formed in a cylindrical shape at the center of the bottom surface of the bezel patch 1221*a*. The injection coupling part 1221*b* is formed in the form of a screw so as to be coupled to a dielectric substance filled in a bezel cavity 1222. The bezel patch 1221*a* may strengthen the bond with the dielectric substance filled in the bezel cavity 1222, through the injection coupling part 1221*b*.

Figure 12D:
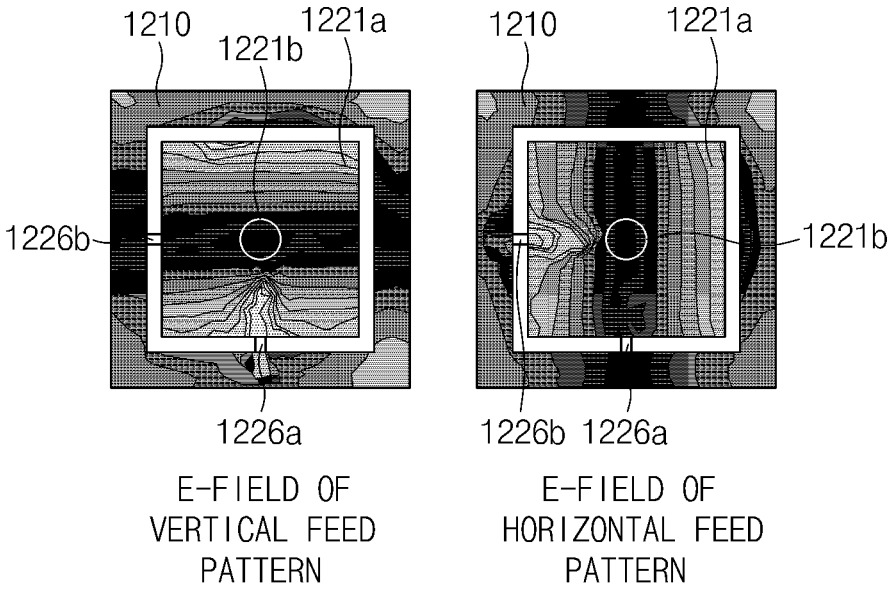
FIG. 12D is a view illustrating an electric field in the case where power is supplied to the antenna module of FIG. 12A.

FIG. 12D is a view illustrating an electric field in the case where power is supplied to the antenna module of FIG. 12A. FIG. 12D illustrates how the injection coupling part 1221*b* affects antenna performance.

Referring to FIG. 12D, when a first feed part 1226*a* or a second feed part 1226*b* is fed, the electric field E-Field formed in the antenna element AE is illustrated. When the power is fed to the first feed part 1226*a* or the second feed part 1226*b*, it may be seen that the electric field is weakest in the central portion of the bezel patch 1221*a*. Accordingly, when the injection coupling part 1221*b* is formed in the central portion of the bezel patch 1221*a*, the change in antenna performance due to the injection coupling part 1221*b* may be minimized.

Figure 13:
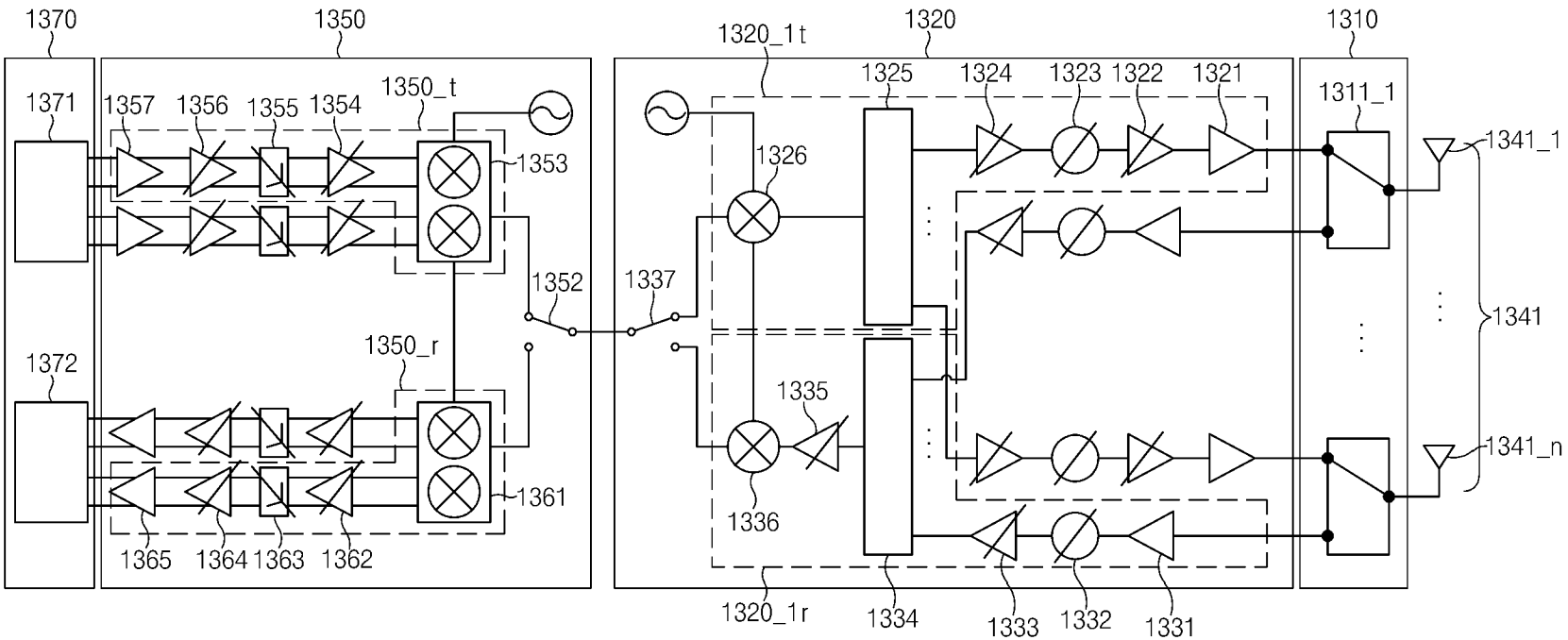
FIG. 13 is a communication system of an electronic device, according to an embodiment.

FIG. 13 is a communication system of an electronic device, according to an embodiment of the disclosure.

Referring to FIG. 13, a communication system (e.g., the communication module 190) may include a switch group 1310, an RF IC 1320, an IF IC 1350, and a communication processor 1370. In certain embodiments, the communication system may further include one or more components not illustrated in FIG. 4 or may not include a part of components illustrated in FIG. 4. For example, an additional RF IC may be added to the components of the communication system.

According to an embodiment, an antenna element (e.g., 1341_1 or 1341_*n*) included in a first antenna array 1341 may be connected with an RF IC 1320_1 through a switch 1311_1 included in the switch group 1310. For example, in the case where an electronic device (e.g., the electronic device 101) transmits an RF signal (e.g., in the case of a signal transmit mode), the switch 1311_1 may connect an antenna element (e.g., 1341_1) and a power amplifier (PA) (e.g., 1321); in the case where the electronic device receives an RF signal (e.g., in the case of a signal receive mode), the switch 1311_1 may connect the antenna element (e.g., 1341_1) and a low noise amplifier (LNA) (e.g., 1331).

According to an embodiment, the RF IC 1320 may include a transmit path 1320_1*t* and a receive path 1320_1*r* with regard to an RF signal.

According to an embodiment, in the case where the electronic device is in the signal transmit mode, the PA 1321, a first variable gain amplifier (VGA) 1322, a phase shifter (PS) 1323, a second VGA 1324, a splitter 1325, and a mixer 1326 may be positioned on the transmit path 1320_1*t* of the RF signal.

The PA 1321 may amplify a power of the RF signal. According to an embodiment, the PA 1321 may be mounted inside or outside the RF IC 1320. The first VGA 1322 and the second VGA 1324 may perform a transmit auto gain control (AGC) operation under control of the communication processor 1370. According to an embodiment, the number of variable gain amplifiers may be 2 or more or may be less than 2. The PS 1323 may change a phase of the RF signal based on a beamforming angle under control of the communication processor 1370. The splitter 1325 may divide an RF signal from the mixer 1326 into 'n' signals. The number of the divided signals may be the same as the number of antenna elements (e.g., 1341_1 to 1341_*n*) included in the first antenna array 1341. The mixer 1326 may upconvert an IF signal from the IF IC 1350 to the RF signal. In an embodiment, the mixer 1326 may receive a signal to be mixed from an internal or external oscillator.

According to an embodiment, in the case where the electronic device is in the signal receive mode, the LNA 1331, a PS 1332, a first VGA 1333, a combiner 1334, a second VGA 1335, and a mixer 1336 may be positioned on the receive path 1320_1*r* of the RF signal.

The LNA 1331 may amplify an RF signal received from an antenna element (e.g., 1341_1 or 1341_*n*). The first VGA 1333 and the second VGA 1335 may perform a receive AGC operation under control of the communication processor 1370. According to an embodiment, the number of variable gain amplifiers may be 2 or more or may be less than 2. The PS 1332 may change a phase of the RF signal based on a beamforming angle under control of the communication processor 1370. The combiner 1334 may combine RF signals aligned in phase through a phase shift operation. The combined signal may be provided to the mixer 1336 through the second VGA 1335. The mixer 1336 may downconvert the received RF signal to an IF signal. In an embodiment, the mixer 1336 may receive a signal to be mixed from an internal or external oscillator.

According to an embodiment, the RF IC 1320 may further include a switch 1337 that electrically connects the mixers 1326 and 1336 and the IF IC 1350. The switch 1337 may selectively connect the transmit path 1320_1*t* or the receive path 1320_1*r* of the RF signal with the IF IC 1350.

According to an embodiment, a mixer 1353, a third VGA 1354, a low pass filter (LPF) 1355, a fourth VGA 1356, and a buffer 1357 may be positioned on the transmit path 1350_*t* of the IF IC 1350. The mixer 1353 may convert a balanced in-phase/quadrature-phase (I/Q) signal of a base band to an IF signal. The LPF 1355 may function as a channel filter which uses a bandwidth of a baseband signal as a cutoff frequency. In an embodiment, the cutoff frequency may be variable. The first VGA 1354 and the second VGA 1356 may perform the transmit AGC operation under control of the communication processor 1370. According to an embodiment, the number of variable gain amplifiers may be 2 or more or may be less than 2. The buffer 1357 may function as buffering upon receiving the Balanced I/Q signal from the communication processor 1370, and thus, the IF IC 1350 may stably process the Balanced I/Q signal.

According to an embodiment, a mixer 1361, a third VGA 1362, an LPF 1363, a fourth VGA 1364, and a buffer 1365 may be positioned on the receive path 1350_*r* of the IF IC 1350. The functions of the third VGA 1362, the LPF 1363, and the fourth VGA 1364 may be the same as or similar to the functions of the third VGA 1354, the LPF 1355, and the fourth VGA 1356 positioned on the transmit path 1350_*t*. The mixer 1361 may convert the IF signal from the RF IC 1320 into a balanced I/Q signal of the baseband. The buffer 1365 may function as buffering upon providing the communication processor 1370 with the Balanced I/Q signal passing through the fourth VGA 1364, and thus, the IF IC 1350 may stably process the Balanced I/Q signal.

According to an embodiment, the communication processor 1370 may include a Tx I/Q digital analog converter (DAC) 1371 and an Rx I/Q analog digital converter (ADC) 1372. In an embodiment, the Tx I/Q DAC 1371 may convert a digital signal modulated by a modem to the Balanced I/Q signal and may provide the Balanced I/Q signal to the IF IC 1350. In an embodiment, the Rx I/Q ADC 1372 may convert the Balanced I/Q signal which is converted by the IF IC 1350 and may provide the digital signal to the modem. According to certain embodiments, the communication processor 1370 may perform multi input multi output (MIMO) or diversity. According to certain embodiments, the communication processor 1370 may be implemented with a separate chip or may be implemented in one chip together with any other component (e.g., the IF IC 1350).

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

According to embodiments disclosed in the specification, an antenna module may not affect the appearance of an electronic device by forming a very thin slit on a metal bezel and by forming an antenna module on the metal bezel itself.

According to embodiments disclosed in the specification, an antenna module may be formed on a metal bezel itself and may be used as a key input device.

According to embodiments disclosed in the specification, an antenna module may have a plurality of frequency bands by forming a plurality of slits of different sizes on a metal bezel.

A variety of effects directly or indirectly understood through this disclosure may be provided.

While the disclosure has been shown and described with reference to certain embodiments thereof, it will be understood by those skilled in the art that various changes in form and details may be made therein without departing from the spirit and scope of the disclosure as defined by the appended claims and their equivalents.

What is claimed is:

1. An electronic device comprising:

a metal bezel including a bezel patch separated through a bezel slit;

a printed circuit board including a first conductive pattern and a second conductive pattern separated by a substrate slit; and a communication module configured to transmit or receive radio frequency signals using the bezel patch, the first conductive pattern, and the second conductive pattern, wherein the first conductive pattern is connected to a part of the metal bezel;

wherein the second conductive pattern is disposed directly under the bezel patch, and wherein a bezel cavity is formed between the bezel patch and the second conductive pattern.

2. The electronic device of claim 1, wherein the bezel cavity is filled with a dielectric substance.

3. The electronic device of claim 1, wherein the printed circuit board includes a first feed part and a second feed part for feeding the first conductive pattern and the second conductive pattern, and wherein the first feed part and the second feed part feed the substrate slit through a coupling scheme.

4. The electronic device of claim 3, wherein the first feed part is disposed in a direction perpendicular to the second feed part.

5. The electronic device of claim 1, wherein the bezel slit is a first bezel slit, wherein the bezel patch is separated into an outer bezel patch and inner bezel patch through a second bezel slit, and wherein the outer bezel patch is disposed to surround a periphery of the inner bezel patch.

6. The electronic device of claim 5, wherein a width of the second bezel slit is less than a width of the first bezel slit.

7. The electronic device of claim 5, wherein a length of a side of the second conductive pattern is equal to a length of a side of the outer bezel patch.

8. The electronic device of claim 1, wherein a width of the substrate slit is equal to a width of the bezel slit.

9. The electronic device of claim 1, further comprising:

a first inductor connected between the metal bezel and the bezel patch;

a second inductor connected to the second conductive pattern;

a first capacitive sensor connected to the metal bezel and configured to generate a sensor signal; and a second capacitive sensor connected to the second inductor and configured to sense a change of a magnitude of the sensor signal.

10. The electronic device of claim 9, wherein the second capacitive sensor determines that there is a touch input when the magnitude of the sensor signal is reduced to be less than a threshold value.

11. The electronic device of claim 1, wherein the bezel patch includes an injection coupling part disposed at a center of the bezel patch.

12. The electronic device of claim 11, wherein the cavity is filled with a dielectric substance and wherein the injection coupling part is formed in a screw shape and is coupled with the dielectric substance.

13. An electronic device comprising:

a metal bezel;

an antenna array formed in a part of the metal bezel; and a communication module configured to transmit or receive an antenna signal, using the antenna array, wherein the antenna array includes:

a plurality of bezel patches separated from the metal bezel through a plurality of bezel slits; and a printed circuit board including a plurality of first conductive patterns and a plurality of second conductive patterns, wherein one of the first conductive patterns is separated from one of the second conductive patterns through a substrate slit, wherein the first conductive patterns is connected to the part of the metal bezel, wherein one of the plurality of bezel patches is disposed directly above one of the second conductive patterns, and wherein a bezel cavity is formed between the one of the plurality of bezel patches and the one of the second conductive patterns.

14. The electronic device of claim 13, wherein the metal bezel includes a switch bezel patch separated through a switch separation slit, and wherein the plurality of bezel patches are formed in the switch separation bezel patch.

15. The electronic device of claim 14, wherein the printed circuit board is disposed directly under the switch bezel patch and wherein the electronic device further comprises:

a switch configured to operate depending on a movement of the switch bezel patch.

16. The electronic device of claim 15, further comprising:

a control printed circuit board connected to the printed circuit board through a flexible printed circuit board and including a communication circuit.

17. The electronic device of claim 15, further comprising:

a reinforcement member interposed between the printed circuit board and the switch.

18. The electronic device of claim 15, further comprising:

a switch support member fixing the switch on the printed circuit board.

19. The electronic device of claim 13, wherein one of the bezel slits is directly above one of the substrate slits.

20. An antenna module formed in a part of a metal bezel of an electronic device, the antenna module comprising:

a bezel patch separated from the metal bezel through a bezel slit; and a printed circuit board including a first conductive pattern and a second conductive pattern, which are separated through a substrate slit, wherein the first conductive pattern is connected to the part of the metal bezel, wherein the second conductive pattern is disposed directly below the bezel patch, and wherein a bezel cavity is formed between the bezel patch and the second conductive pattern.

* * * * *